US012172094B2

(12) United States Patent
Miyama et al.

(10) Patent No.: US 12,172,094 B2
(45) Date of Patent: Dec. 24, 2024

(54) STEERING MECHANISM OF MODEL VEHICLE AND SERVO MOTOR FOR STEERING

(71) Applicant: Futaba Corporation, Mobara (JP)

(72) Inventors: Yuki Miyama, Mobara (JP); Yukihiro Dobashi, Mobara (JP)

(73) Assignee: Futaba Corporation, Mobara (JP)

( * ) Notice: Subject to any disclaimer, the term of this patent is extended or adjusted under 35 U.S.C. 154(b) by 317 days.

(21) Appl. No.: 17/828,679

(22) Filed: May 31, 2022

(65) Prior Publication Data

US 2022/0379229 A1 Dec. 1, 2022

(30) Foreign Application Priority Data

May 31, 2021 (JP) ..... 2021-091840

(51) Int. Cl.
*A63H 17/36* (2006.01)

(52) U.S. Cl.
CPC ..... *A63H 17/36* (2013.01)

(58) Field of Classification Search
CPC ..... A63H 17/262; A63H 17/36; A63H 17/26; A63H 29/22
USPC ..... 446/460, 468
See application file for complete search history.

(56) References Cited

U.S. PATENT DOCUMENTS 4,197,672 A * 4/1980 Mabuchi ..... A63H 17/36 446/456
4,387,532 A * 6/1983 Suimon ..... A63H 17/21 446/460
4,471,566 A * 9/1984 Ishimoto ..... A63H 17/36 446/460
4,571,213 A * 2/1986 Ishimoto ..... A63H 17/36 446/460
4,755,161 A * 7/1988 Yang ..... A63H 17/395 446/436
4,898,562 A * 2/1990 Ishimoto ..... A63H 17/36 446/460
6,095,892 A * 8/2000 Moe ..... A63H 17/21 446/431
6,170,354 B1 * 1/2001 Lee ..... A63H 31/00 280/89.11
6,428,383 B1 * 8/2002 Allmon ..... A63H 17/268 446/454
6,945,843 B1 * 9/2005 Motosko ..... A63H 17/262 446/457

(Continued)

FOREIGN PATENT DOCUMENTS

| | | | |
|---|---|---|---|
| CN | 203581090 | U | 5/2014 |
| JP | 2001029669 | A | 2/2001 |
| KR | 101409379 | B1 | 7/2014 |

*Primary Examiner* — Alexander R Niconovich
(74) *Attorney, Agent, or Firm* — Quarles & Brady LLP

(57) ABSTRACT

A steering mechanism of a model vehicle which improves steering control accuracy is provided. The steering mechanism of the model vehicle includes the servo motor for steering configured to rotationally drive a steerable wheel of a model vehicle in a steering angle direction, the servo motor for steering being positioned between arm parts and the steerable wheel, the arm parts extending from a vehicle body side of the model vehicle to the steerable wheel. The servo motor for steering includes an output shaft parallel to a steering rotation axis of the steerable wheel and is configured to rotationally drive the steerable wheel by the output shaft.

17 Claims, 15 Drawing Sheets

(56) References Cited

U.S. PATENT DOCUMENTS

| | | | | |
|---|---|---|---|---|
| 6,997,774 | B2 * | 2/2006 | Kaneko | A63H 17/36 446/466 |
| 7,503,828 | B2 * | 3/2009 | Lee | A63H 17/36 446/460 |
| 7,938,709 | B2 * | 5/2011 | Leonov | A63H 17/36 446/454 |
| 8,002,606 | B2 * | 8/2011 | Wong | A63H 17/36 446/469 |
| 8,932,102 | B2 * | 1/2015 | Wong | A63H 17/395 446/460 |
| 9,975,056 | B2 * | 5/2018 | Kawamura | G05D 1/0011 |
| 10,073,448 | B2 * | 9/2018 | Kawamura | G05D 1/0016 |
| 10,232,277 | B2 * | 3/2019 | Mueller | A63H 17/262 |
| 2006/0079151 | A1 * | 4/2006 | Suimon | A63H 17/36 446/460 |
| 2006/0226621 | A1 * | 10/2006 | Byers | A63H 17/26 280/86.757 |
| 2014/0227941 | A1 * | 8/2014 | Suzuki | A63H 17/36 446/456 |
| 2018/0185761 | A1 * | 7/2018 | Webster | A63H 30/04 |

* cited by examiner

WHEN RUNNING STRAIGHT

WHEN STEERED TO TURN RIGHT

STEERING MECHANISM OF MODEL VEHICLE AND SERVO MOTOR FOR STEERING

CROSS-REFERENCE TO RELATED APPLICATION

This application claims the priority benefit of Japanese Patent Application No. 2021-091840 filed May 31, 2021, which is fully incorporated herein by reference.

TECHNICAL FIELD

The present invention relates to a technical field of a steering mechanism of a model vehicle and to a servo motor for steering used as a drive source for steering in the steering mechanism of the model vehicle.

BACKGROUND

A model vehicle may include a steering mechanism for steerably driving steerable wheels such as right and left front wheels (e.g., refer to Patent Document 1 mentioned below).

PRIOR ART DOCUMENT

Patent Document 1: JP 2001-29669 A

SUMMARY OF THE INVENTION

Problem to be Solved by the Invention

As disclosed in Patent Document 1, a conventional steering mechanism of a model vehicle may include a servo motor for steering disposed on a vehicle body (i.e., chassis) side, and it is configured to transmit a rotational drive force generated by the servo motor for steering to a steerable wheel side via a link mechanism intended for steering. Specifically, this link mechanism is a link mechanism that converts a rotational motion generated by the servo motor for steering into a translational motion in a right-left direction.

However, considerable connection backlash is generated in the above-described link mechanism, and this connection backlash causes a decrease in steering control accuracy. Further, since the above-described link mechanism is configured to convert the rotational motion of the motor into the translational motion in the right-left direction to drive the steerable wheels, the amount of change in a rotation angle of the steerable wheel with respect to the change in a rotation angle of a motor output shaft is changed depending on a steering angle, and this could also cause a decrease in the steering control accuracy.

In view of the above-described drawbacks, an object of the present invention is to improve steering control accuracy in a steering mechanism of a model vehicle.

Solution to the Problem

The present invention provides, in one aspect, a steering mechanism of a model vehicle including a steerable wheel of the model vehicle, arm parts extending from a vehicle body side of the model vehicle to the steerable wheel, and a servo motor for steering configured to rotationally drive the steerable wheel in a steering angle direction, wherein the servo motor for steering is positioned between the arm parts and the steerable wheel and is configured to rotationally drive the steerable wheel by an output shaft parallel to a steering rotation axis of the steerable wheel. Since the servo motor for steering is positioned between the steerable wheel and the arm parts and is configured to rotationally drive the steerable wheel by the output shaft parallel to the steering rotation axis as described above, it is possible to eliminate the need for the link mechanism for steering that was required when the servo motor for steering is disposed on the vehicle body side as in the conventional art, and it is also possible to synchronize the rotation angle of the servo motor for steering synchronized with the rotation angle of the steerable wheel.

Further, the present invention provides, in another aspect, a servo motor for steering according to the embodiment is configured to rotationally drive a steerable wheel of a model vehicle in a steering angle direction, wherein the servo motor for steering is positioned between arm parts and the steerable wheel, the arm parts extending from a vehicle body side of the model vehicle to the steerable wheel, and the servo motor for steering comprises an output shaft parallel to a steering rotation axis of the steerable wheel and is configured to rotationally drive the steerable wheel by the output shaft. The same operation as the steering mechanism according to the above-described embodiment can be obtained with this servo motor for steering.

Advantageous Effect of the Invention

According to the present invention, it is possible to improve steering control accuracy in a steering mechanism of a model vehicle.

DETAILED DESCRIPTION OF THE EXEMPLARY EMBODIMENTS

Figure 1:
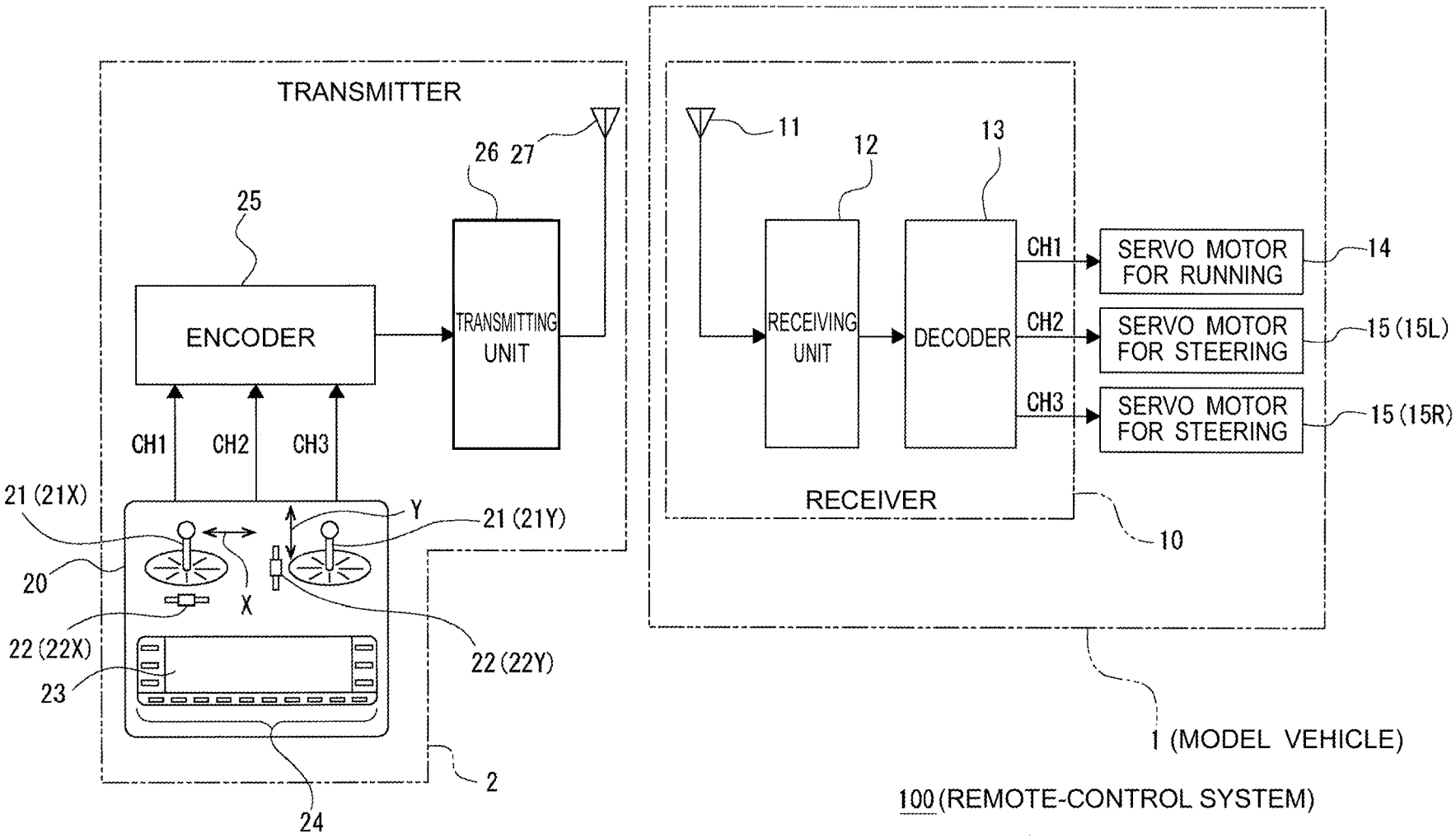
FIG. 1 is a block diagram illustrating an electrical configuration of a remote-control (radio-control) system according to an embodiment of the present invention.

Hereinafter, an embodiment of the present invention will be described in the following order:

1. Overview of Configuration of Remote-Control System
2. Steering mechanism according to an embodiment
3. Input attenuation mechanism
4. Another example of steering mechanism
4-1. First another example
4-2. Second another example and third another example
5. Angle adjusting mechanism
6. Modified example
7. Summary of the embodiment 1. Overview of Configuration of Remote-Control System FIG. 1 is a block diagram illustrating an electrical configuration of a remote-control (radio-control) system 100 according to an embodiment. The remote-control system 100 includes, at least, a model vehicle 1 as an object to be operated, and a transmitter 2 which functions as a controller for wirelessly operating the model vehicle 1.

Although not shown, the model vehicle 1 in this example is configured as a four-wheeled vehicle having a total of four wheels, one pair for each of front and rear sides, where a pair of right and left wheels as front wheels are steerable wheels W for turning the model vehicle 1, and a pair of right and left wheels as rear wheels are drive wheels for causing the model vehicle 1 to run. In the following, the left steerable wheel W is referred to as "steerable wheel WL", and the right steerable wheel W is referred to as "steerable wheel WR".

The model vehicle 1 includes, at least, a receiver 10 for receiving an operation signal from the transmitter 2, and a servo motor for running 14 and servo motors for steering 15 which are provided as servo motors configured to perform acceleration or deceleration and steering. In the model vehicle 1 of this example, the servo motors for steering 15 includes a servo motor for steering 15 for rotationally driving the left steerable wheel WL in a steering angle direction (hereinafter referred to as "servo motor for steering 15L") and a servo motor for steering 15 for rotationally driving the right steerable wheel WR in a steering angle direction (hereinafter referred to as "servo motor for steering 15R"). The servo motor for running 14 is a servo motor for adjusting a carburetor in an engine (not shown) mounted on the model vehicle 1. The model vehicle 1 of this example is an engine vehicle, and the rear wheels are driven by the engine as a drive source. With the rotational control of this servo motor for running 14, it is possible to control the acceleration (an accelerator) and the deceleration (a brake) of the model vehicle 1. It is also possible that the model vehicle 1 is configured to drive the wheels by a motor as a drive source. In this case, it includes an ESC (speed controller) for controlling the motor for running.

The receiver 10 in the model vehicle 1 will be described later in more detail.

The transmitter 2 performs high-frequency modulation on an operation signal for wirelessly operating the model vehicle 1 and transmits it as an electrical wave. As shown, the transmitter 2 includes an interface unit 20, an encoder 25, a transmitting unit 26 and an antenna 27.

The interface unit 20 performs a user interface operation such as receiving an operation input from a user as an operator and presenting various information to the user. The interface unit 20 includes two operation levers 21, two trim switches 22, the display unit 23, and the setting operation unit 24.

The operation lever 21 includes an operation lever 21X for controlling the steering of the model vehicle 1 and an operation lever 21Y for controlling acceleration and deceleration of the model vehicle 1. In the example shown in FIG. 1, the orientation of the steerable wheels W can be controlled by operating the steering operation lever 21X in a direction indicated by an arrow X (i.e., a right-left direction on a paper plane), and the acceleration and deceleration of the model vehicle 1 can be controlled by operating the other operation lever 21Y in a direction indicated by an arrow Y (i.e., an up-down direction on a paper plane). The operation elements for acceleration or deceleration and steering are not limited to the lever-shaped operation elements shown in this example, and operation elements having other forms such as a wheel-shaped operation element may also be used.

In this embodiment, the servo motor for steering 15 of the model vehicle 1 is provided for each of the right and left steerable wheels W as described above, thus a signal for driving the left servo motor for steering 15L and a signal for driving the right servo motor for steering 15R are generated separately depending on the operation of the operation lever 21X. In this example, the operation lever 21X is configured to change a resistance value of a variable resistor in accordance with an operation amount (displacement) to output a control signal for each of the servo motors for steering 15L and 15R. The operation lever 21Y is also configured to change a resistance value of a variable resistor in accordance with an operation amount to output a control signal for the servo motor for running 14.

Using the operation levers 21X, 21Y as described above, control signals for a total of three channels for the servo motor for steering 15L, the servo motor for steering 15R and the servo motor for running 14 are generated in the transmitter 2. These control signals for the respective channels which are generated based on the operation of the operation lever 21X and the operation lever 21Y are shown in the drawing as signals CH1, CH2, CH3. Herein, the signal CH1 is a control signal for the servo motor for running 14, and the signals CH2 and CH3 are control signals for the servo motors for steering 15L and 15R, respectively. As shown, these signals CH1, CH2, CH3 are inputted to the encoder 25.

It is noted that the channel assignment as described above is illustrative only, and the combination of the channel and the signal may be changed as needed such that, for example, CH1 is assigned to the steering signals (for right and left steering) and CH2 is assigned to the running signal.

Further, the interface unit 20 is provided with trim switches 22 for adjusting a resistance value of the variable resistor (i.e., a value of the control signal for the servo motor) with respect to a neutral position when the operation lever 21 is not being operated. In this example, the trim switches 22 (22X, 22Y in the drawing) are provided the operation levers 21X, 21Y, respectively. It is also possible to use the later-described setting operation unit 24 for the adjustment of the resistance value of the variable resistor with respect to the neutral position described above.

Further, the interface unit 20 is provide with the display unit 23 constituted of an LCD (Liquid Crystal Display) or an organic EL (Electro-Luminescence) display. Using a setting screen displayed on this display unit 23, a user can configure various settings related to the operation of the model vehicle 1 using various operation elements included in the setting operation unit 24. For example, as the setting related to the steering, it is possible to set a maximum steering angle of the steerable wheel W. Herein, regarding the setting, it is also possible to configure the setting related to whether or not to control to change a toe angle of the steerable wheels WL and WR (i.e., control to improve the straightness) in response to a braking operation or an accelerating operation by the operation lever 21Y. In this case, the adjustment of the toe angle is enabled by superimposing a signal for the toe angle adjustment on the control signal of the servo motor for steering 15L, 15R.

In the transmitter 2, the encoder 25 performs, for example, the pulse-width modulation on the signals CH1, CH2, CH3 of the respective channels inputted from the interface unit 20, performs time-division multiplexing at a predetermined frame period on the signals CH1, CH2, CH3, and outputs the time-division multiplexed signals. The time-division multiplexed signals CH1, CH2, CH3 are inputted to the transmitting unit 26, and the transmitting unit 26 performs the amplitude modulation or the frequency modulation on the time-division multiplexed signals CH1, CH2, CH3, and transmits the modulated signals as the operation signals from the antenna 27 where they are emitted as an electric wave.

In the model vehicle 1, the receiver 10 includes an antenna 11, a receiving unit 12 and a decoder 13. The receiver 10 receives the operation signals transmitted from the transmitter 2 via the antenna 11, demodulates these operation signals and outputs the demodulated received signals to the decoder 13.

The decoder 13 divides the operation signals received by the receiver 10 into the signals CH1, CH2, CH3 of the respective channels, and outputs the divided signals CH1, CH2, CH3 to the corresponding servo motor out of the servo motor for running 14 and the servo motors for steering 15L, 15R, respectively. Specifically, in this example, the signal CH1 is outputted to the servo motor for running 14, the signal CH2 is outputted to the servo motor for steering 15L, and the signal CH3 is outputted to the servo motor for steering 15R. Thus, the servo motors for steering 15L, 15R are drive controlled in accordance with the operation of the operation lever 21X, thereby enabling the steering of the model vehicle 1 in accordance with the operation of the operation lever 21X. Further, the servo motor for running 14 is drive controlled in accordance with the operation of the operation lever 21Y, and the model vehicle 1 is thus accelerated and decelerated in accordance with the operation of the operation lever 21Y.

2. Steering Mechanism According to an Embodiment

Figure 2:
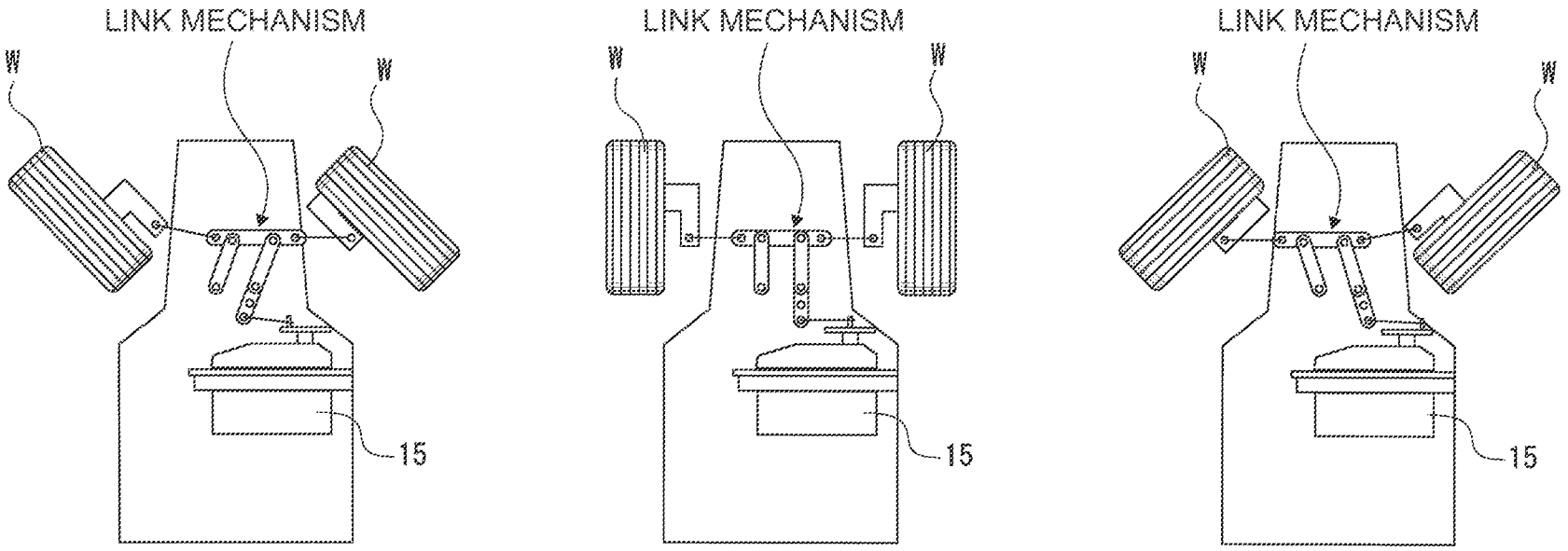
FIG. 2 is a diagram showing an example of a configuration of a steering mechanism which uses a link mechanism.

With respect to a steering mechanism of the model vehicle 1, it is conceivable that the servo motor for steering 15 could be provided on the vehicle body (i.e., chassis) side such that a rotational drive force generated by the servo motor for steering 15 is transmitted to the steerable wheel side via a link mechanism for steering, as described in Patent Document 1 mentioned above. FIG. 2 shows a configuration disclosed in FIG. 6 of Patent Document 1, as an example of a steering mechanism using such a conventional link mechanism. As will be understood from FIG. 2, depending on the link mechanism used, a rotational drive force generated by the servo motor for steering 15 is converted into a translational motion in the right-left direction so that the right and left steerable wheels W are rotationally driven in the steering angle direction.

In the above-described link mechanism, however, considerable connection backlash is generated, and this connection backlash causes a decrease in steering control accuracy. Further, since the above-described link mechanism is configured to convert the rotational motion of the servo motor for steering 15 into the translational motion in the right-left direction to drive the steerable wheels W, the amount of change in the rotation angle of the steerable wheel W with respect to the change in the rotation angle of an output shaft of the servo motor for steering 15 is changed depending on the steering angle, and this could also cause a decrease in steering control accuracy.

Figure 3:
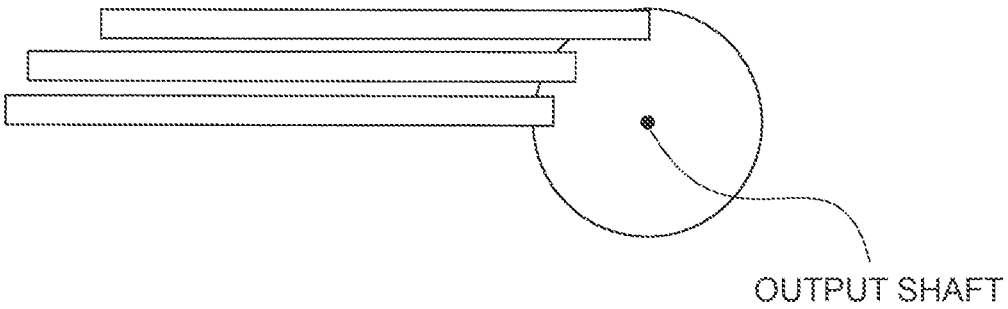
FIG. 3 illustrates a steering angle dependency of an amount of change in a rotation angle of a steerable wheel.

FIG. 3 illustrates a steering angle dependency of the amount of change in the rotation angle of the steerable wheel W. As can be seen from FIG. 3, in the case where the above-described link mechanism is used, the amount of change in the rotation angle of the steerable wheel W with respect to the change in the rotation angle of the output shaft of the servo motor for steering 15 is relatively large in a region where the steering angle is small, whereas in a region where the steering angle is large, the amount of change in the rotation angle of the steerable wheel W with respect to the change in the rotation angle of the output shaft of the servo motor for steering 15 is relatively small, thus the amount of change in the rotation angle of the steerable wheel W varies depending on the steering angle.

In view of these drawbacks, the steering mechanism of the model vehicle 1 according to this embodiment is configured such that the servo motor for steering 15 is disposed between the steerable wheel W and arm parts extending from the vehicle body side, that is, it is configured as an in-wheel servo motor.

Figure 4:
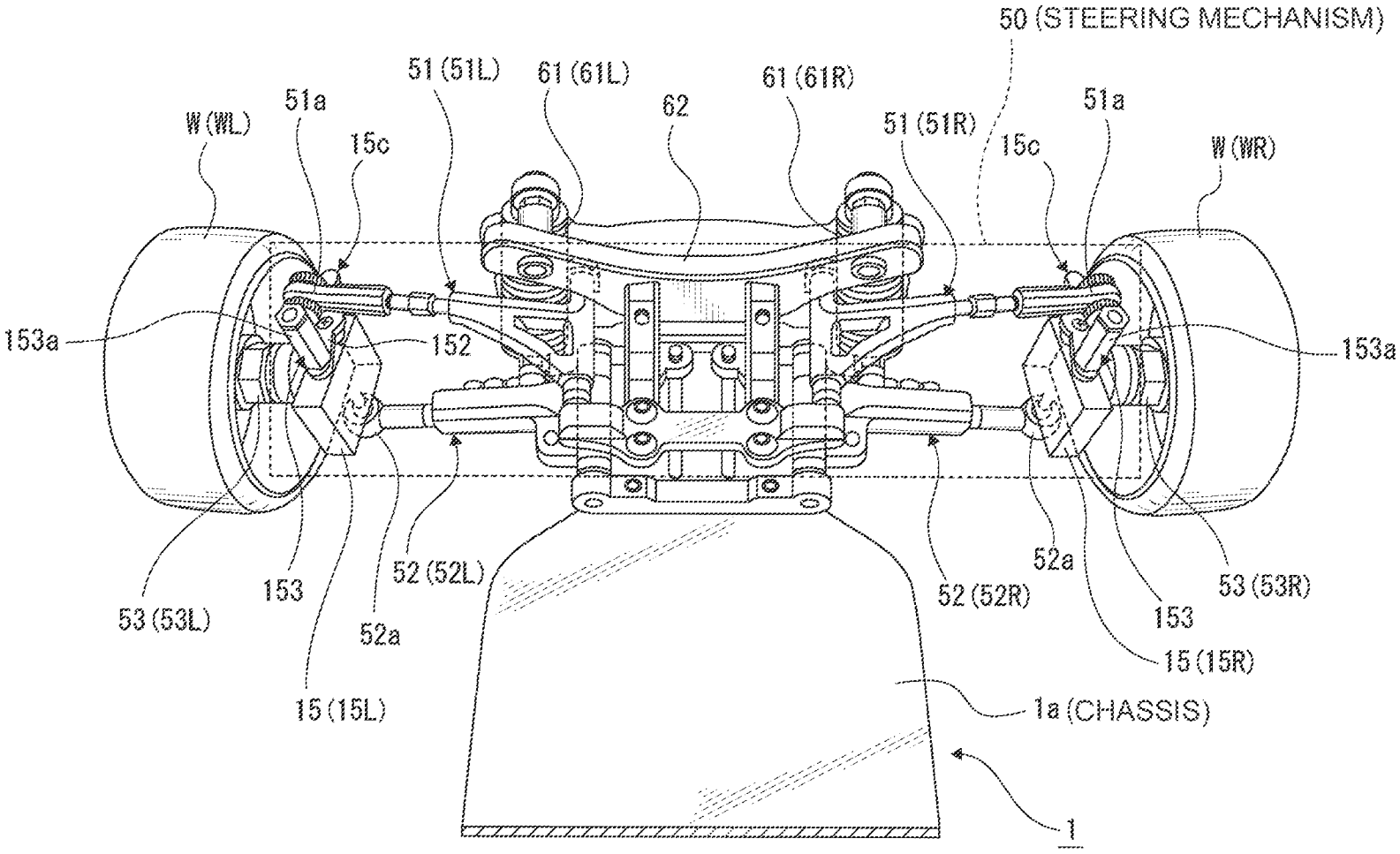
FIG. 4 is a perspective view of an external appearance of a model vehicle of the embodiment showing a part of the model vehicle in the vicinity of the steering mechanism.
Figure 5:
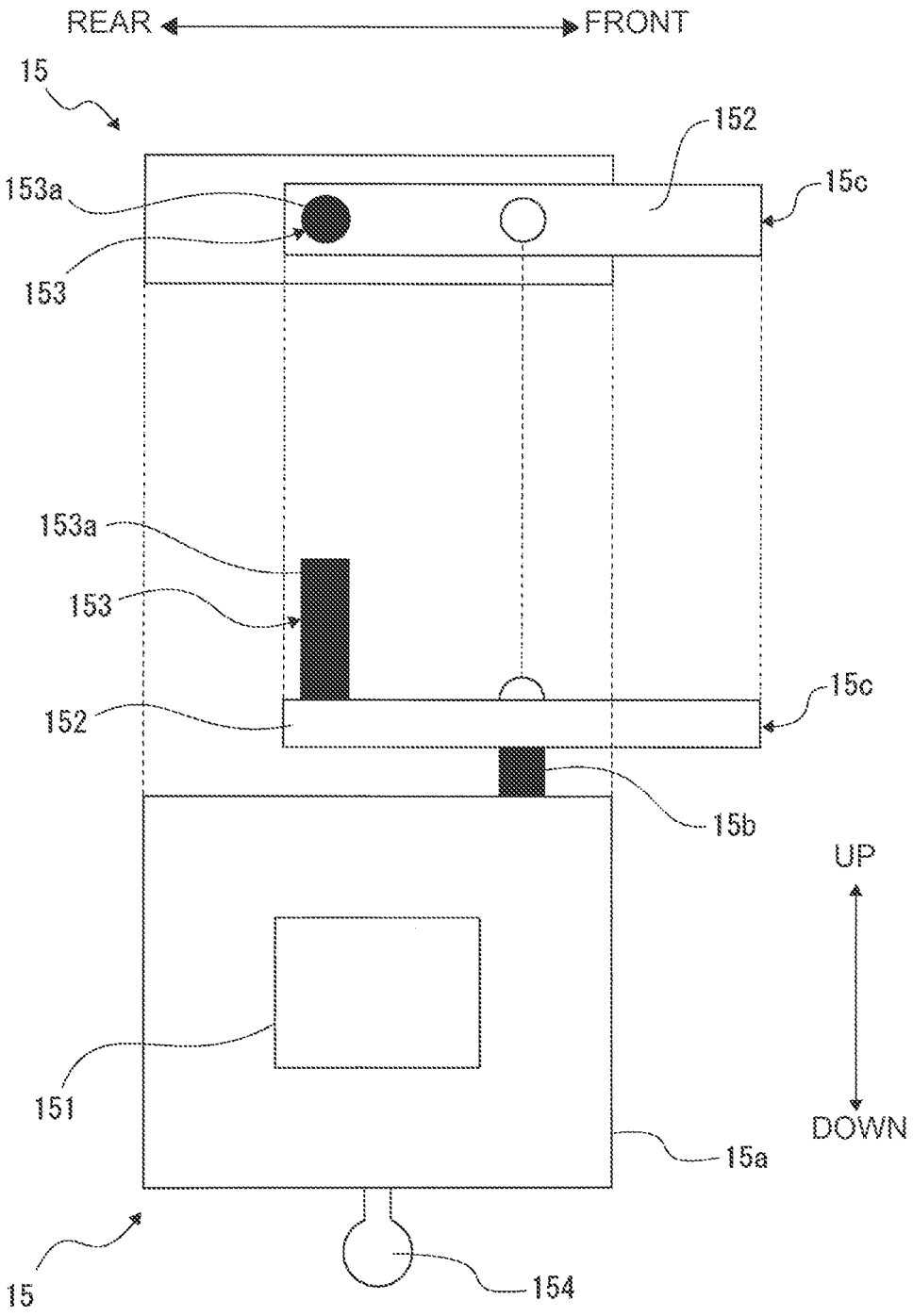
FIG. 5 is an illustrative diagram showing an external configuration of a servo motor for steering of the embodiment.
Figure 6:
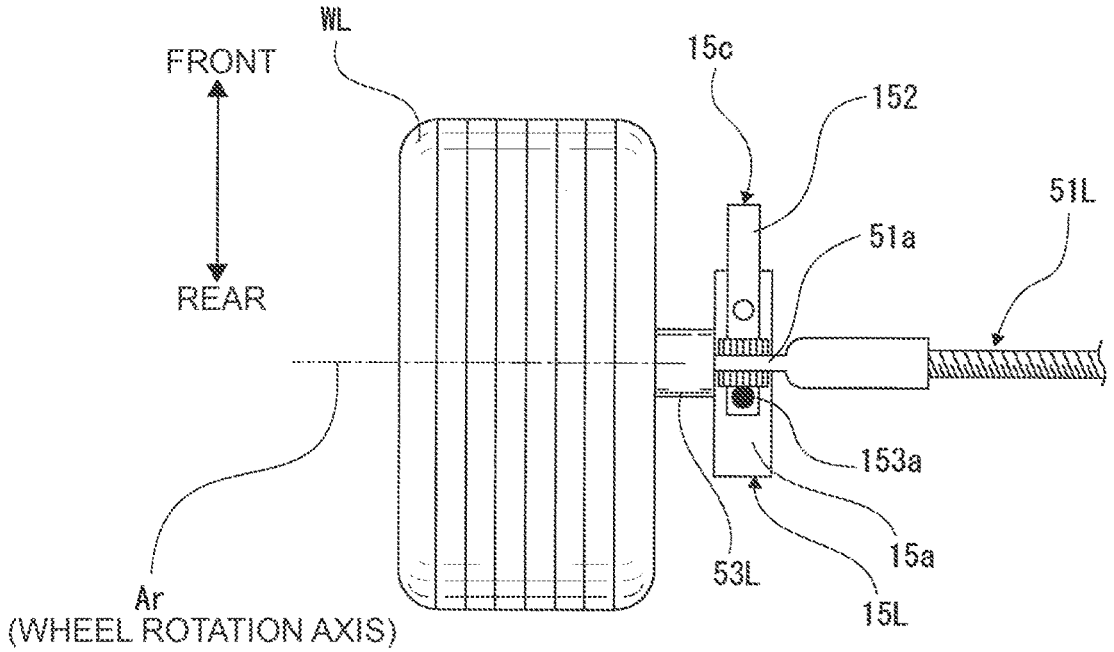
FIG. 6 shows a part in the vicinity of a left steerable wheel when running straight.
Figure 6:
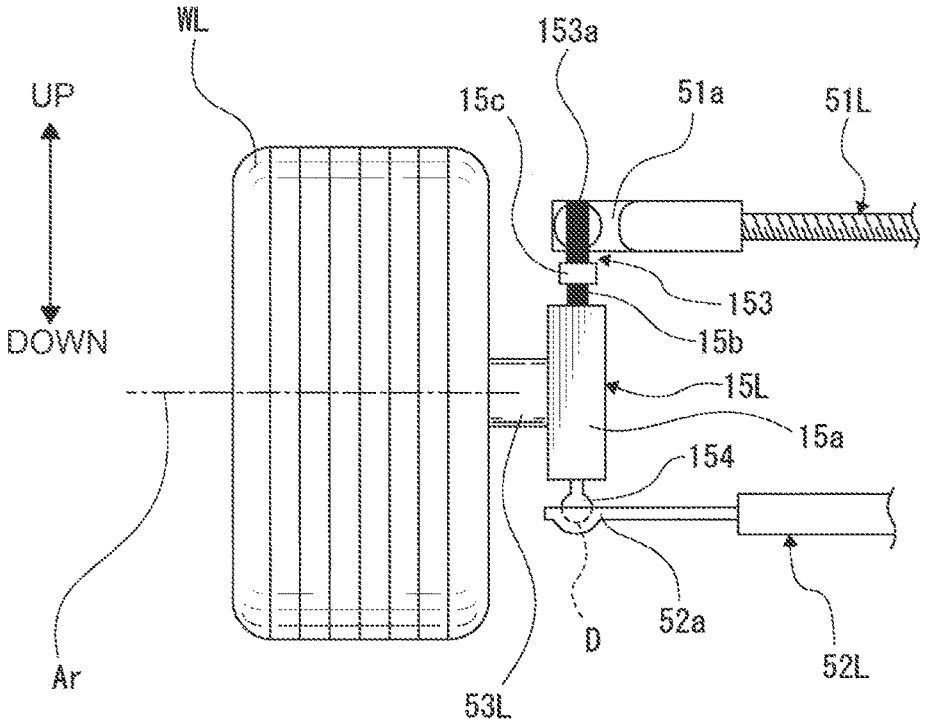
Figure 7:
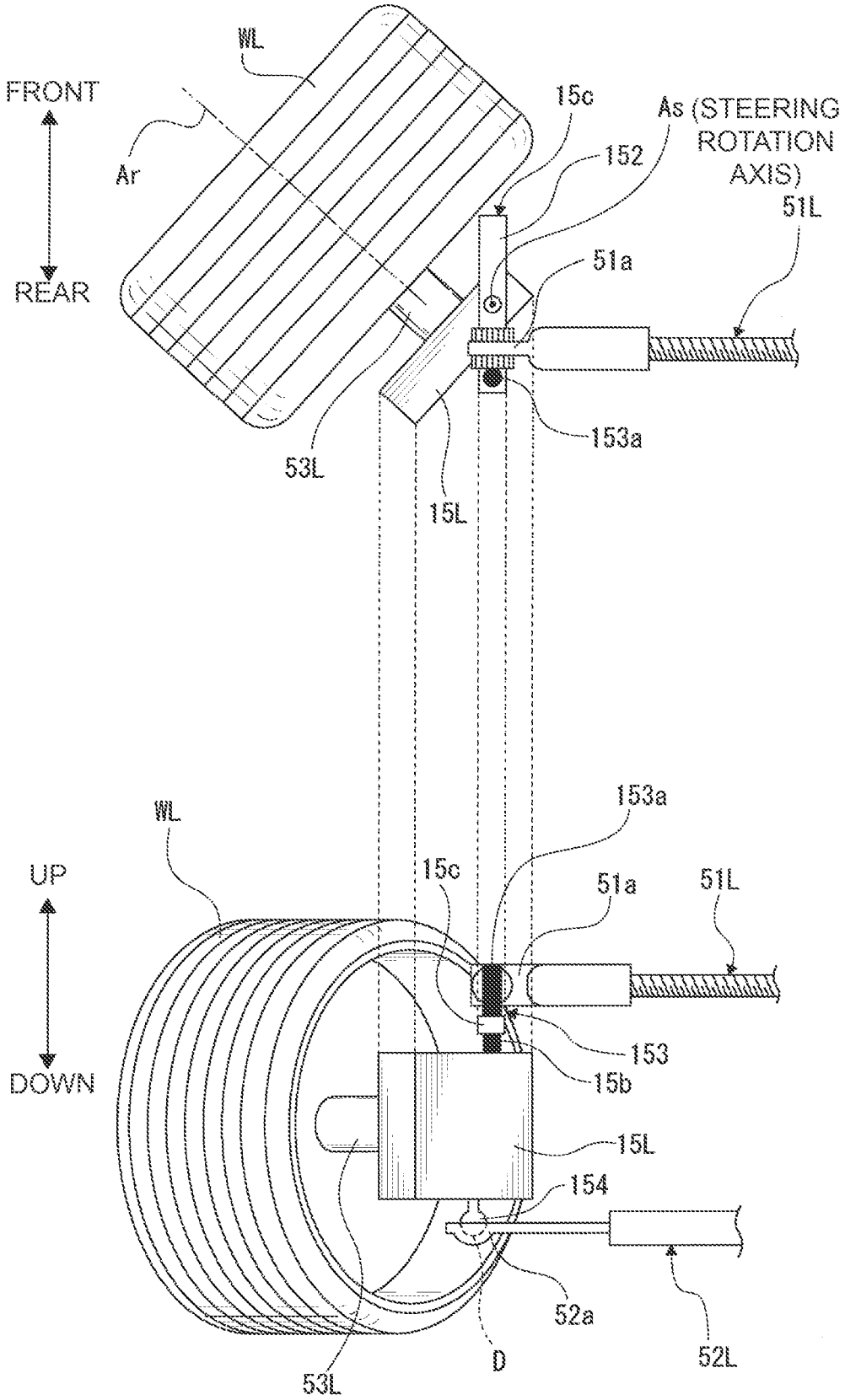
FIG. 7 shows a part in the vicinity of the left steerable wheel when being steered to turn to the right.

Referring to FIG. 4 to FIG. 7, a steering mechanism 50 provided in the model vehicle 1 according to an embodiment will be described. FIG. 4 is a perspective view of an external appearance of the model vehicle 1 and shows a part of the model vehicle 1 in the vicinity of the steering mechanism 50. FIG. 5 is an illustrative diagram showing an external configuration of the servo motor for steering 15. FIG. 6 and FIG. 7 show a part in the vicinity of the left steerable wheel WL when running straight and when steered to turn right, respectively. FIG. 4 does not show wiring for the servo motor for steering 15 and does not show the receiver 10 and the servo motor for running 14. FIG. 5 shows a top view (upper side in FIG. 5) and a side view (lower side in FIG. 5), respectively, of the servo motor for steering 15. FIG. 6 shows a top view (upper side in FIG. 6) and a rear view, i.e., a view from the vehicle rear side (lower side in FIG. 6), respectively, of a part in the vicinity of the left steerable wheel WL.

The steering mechanism 50 is disposed in the vicinity of a front end of a chassis 1*a* of the model vehicle 1 (see FIG. 4). In this example, the steering mechanism 50 has a bilaterally symmetrical configuration and includes, at least, an upper arm 51, a lower arm 52, the servo motor for steering 15, a wheel hub part 53 and the steerable wheel W on each of the right and left sides. In the following description, when the right and left components of the steering mechanism 50 are described in a manner distinguished from each other, "L" is added at the end of the reference sign for the left components, and "R" is added to the end of the reference sign for the right components.

FIG. 4 shows shock absorbers 61 (61L and 61R) and a shock tower 62 as underbody components of the model vehicle 1 which are described later.

The upper arm 51 and the lower arm 52 each function as an arm part for supporting the steerable wheel W from the chassis 1*a* side and are vertically spaced apart from each other. The upper arm 51 and the lower arm 52 extend outward with respect to the vehicle body with their basal parts attached to the chassis 1*a* side, and parts in the vicinity of the distal ends (i.e., farthest parts from the chassis 1*a* side)

of the upper arm 51 and the lower arm 52 are formed as a distal end part 51*a* and a distal end part 52*a*, respectively.

In this example, the servo motor for steering 15 is disposed between the distal end part 51*a* of the upper arm 51 and the distal end part 52*a* of the lower arm 52, and the steerable wheel W is coupled to the servo motor for steering 15 through the wheel hub part 53.

The servo motor for steering 15 includes a main body part 15*a* and an output shaft 15*b* (see FIG. 5). The output shaft 15*b* is a shaft for outputting a rotational drive force generated by the motor, and the main body part 15*a* is a part that rotatably holds the output shaft 15*b*. As shown, the main body part 15*a* of this example has a substantially rectangular parallelepiped shape, and the output shaft 15*b* protrudes upward from an upper surface of the main body part 15*a*. Herein, the directions are described in accordance with the directions of the components when they are attached to the model vehicle 1.

A to-be-connected part 151 to which the wheel hub part 53 is connected is formed on a lateral surface of the main body part 15*a*. In this example, the to-be-connected parts 151 are formed on both of the right and left lateral surfaces of the main body part 15*a* in order to make the servo motor for steering 15 adaptable on both of the right and left sides. A form of connection of the wheel hub part 53 to the to-be-connected part 151 may be various and is not limited to a specific form. For example, the wheel hub part 53 may be connected using one or more screws. In that case, the to-be-connected part 151 may be formed as one or more screw holes. The to-be-connected part 151 preferably includes a positioning part that defines a connecting position of the wheel hub part 53.

A connecting part 15*c* intended for connection with the upper arm 51 is attached a distal end part of the output shaft 15*b*. The connecting part 15*c* includes a plate-shaped part 152 arranged in parallel to a plane perpendicular to the output shaft 15*b*, and a pole part 153 extending from an end of the plate-shaped part 152 in a direction parallel to the output shaft 15*b* (i.e., in an upward direction, in this example). The plate-shaped part 152 has a substantially rectangular shape in top view, and the distal end part of the output shaft 15*b* is connected to a central portion in a longitudinal direction of the plate-shaped part 152. The pole part 153 is located on one end side out of both ends in the longitudinal direction of the plate-shaped part 152. A part of the pole part 153 in the vicinity of its distal end is formed as a distal end part 153*a*.

Further, a spherical part 154 is formed on a lower surface of the main body part 15*a*. The spherical part 154 is formed to protrude downward from the lower surface of the main body part 15*a*, and a distal end part (i.e., a lower end part) of the spherical part 154 in its protruding direction has a substantially spherical shape.

Referring to FIG. 6 and FIG. 7, a specific form of connection between the upper arm 51 and the lower arm 52 and the servo motor for steering 15 will be described. In the following description, a configuration of the left side of the steering mechanism 50 will be explained as a representative, and an explanation of a configuration of the right side of the steering mechanism 50 will be omitted because it is similar to that of the left side except that it is in a bilaterally symmetrical relationship with respect to the left side. FIG. 6 and FIG. 7 show a wheel rotation axis Ar. The wheel rotation axis Ar is defined as a rotation axis of the wheel when the wheel rotates while the model vehicle 1 is running. In other words, the wheel rotation axis Ar is an axis penetrating a center in a radial direction of the wheel.

In this example, when running straight as shown in FIG. 6, the main body part 15*a* of the servo motor for steering 15L and the plate-shaped part 152 of the connecting part 15*c* are directed in a direction substantially parallel to the front-rear direction, respectively. Specifically, when running straight, the right and left side surfaces of the main body part 15*a* and the longitudinal direction of the plate-shaped part 152 are substantially parallel to the front-rear direction, respectively. In this example, the orientation of the plate-shaped part 152 when running straight is set such that the pole part 153 is positioned on the rear end side, as shown.

In this example, the distal end part 153*a* of the pole part 153 of the connecting part 15*c* is connected to the distal end part 51*a* of the upper arm 51L so as to render the pole part 153 incapable of rotating. Thus, the output shaft 15*b* of the servo motor for steering 15L which is coupled to the pole part 153 via the plate-shaped part 152 is supported from the upper arm 51L side in a manner incapable of rotating.

On the other hand, as shown in FIG. 6, the spherical part 154 provided on the lower surface of the main body part 15*a* of the servo motor for steering 15L is connected to the distal end part 52*a* of the lower arm 52L. Specifically, the distal end part 52*a* of the lower arm 52L includes a recess D to which the spherical portion of the spherical part 154 is fitted in a manner slidable in a direction along its spherical surface, and the spherical part 154 is connected to the lower arm 52L via this recess D. Thus, the main body part 15*a* of the servo motor for steering 15L is supported from the lower arm 52L side in a manner rotatable around an axis parallel to a steering rotation axis (i.e., an axis parallel to the output shaft 15*b*).

The servo motor for steering 15L generates a drive force that rotates the output shaft 15*b* when it is supplied with a drive signal. Since the output shaft 15*b* is supported from the upper arm 51L side in a manner incapable of rotating and the main body part 15*a* is supported from the lower arm 52L side in a manner capable of rotating as described above, the generation of such a rotational drive force causes the main body part 15*a* to rotate around the axis parallel to the steering rotation axis as illustrated in FIG. 7 which illustrates an example of a state of being steered to turn right. Then, in accordance with this rotation of the main body part 15*a*, the steerable wheel WL connected to the side surface of the main body part 15*a* via the wheel hub part 53 will also be rotated around the axis parallel to the steering rotation axis.

As will be understood with reference to FIG. 6 and FIG. 7, the steering rotation axis of the steering mechanism 50 of this example is an axis indicated with "As" in FIG. 7, that is, it is a rotation axis (i.e., an axis penetrating through a center of rotation) of the output shaft 15*b*. Hereinafter, the steering rotation axis is indicated with the reference sign "As".

In the above description, the spherical part 154 formed on the main body part 15*a* is connected to the lower arm 52 and the pole part 153 of the connecting part 15*c* is connected to the upper arm 51, respectively. However, it is also possible to connect the spherical part 154 to the upper arm 51 and connect the pole part 153 to the lower arm 52 to enable a configuration that causes the steerable wheel W to rotate as the main body part 15*a* rotates as described above. In this case, the recess D to which the spherical part 154 is fitted may be formed on the distal end part 51*a* of the upper arm 51, and the distal end part 52*a* of the lower arm 52 may be connected to the distal end part 153*a* in a manner such that the pole part 153 is incapable of rotating. That is, in a way opposite to that described above, the output shaft 15*b* may be supported from the lower arm 52 side in a manner incapable of rotating, and the main body part 15*a* may be supported from the upper arm 51 side in a manner capable of rotating around the axis parallel to the steering rotation axis As. As will be understood from this point, in order to enable a movement in which the steerable wheel W rotates with the rotation of the main body part 15*a*, the steering mechanism 50 is configured at least as follows: the output shaft 15*b* is supported from one of the upper arm 51 side and the lower arm 52 side in a manner incapable rotating; the main body part 15*a* is supported from the other one of the upper arm 51 side and the lower arm 52 side in a manner rotatable around the axis parallel to the steering rotation axis As; and the wheel hub part 53 is coupled to the main body part 15*a*.

The term "couple" and conjugate forms thereof as used herein is a conceptual term and meaning thereof includes not only that elements are directly connected to each other but also that elements are connected to each other via another element. Thus, although in this example the wheel hub part 53 is directly connected to the main body part 15*a*, it is possible to configure such that the wheel hub part 53 is connected to the main body part 15*a* via another element.

As can be understood from the description related to FIG. 4 to FIG. 7, the steering mechanism 50 of this embodiment is configured such that the servo motor for steering 15 which is positioned between the steerable wheel W and the arm parts (the upper arm 51 and the lower arm 52) rotationally drives the steerable wheel W by the output shaft 15*b* parallel to the steering rotation axis As (in this example, the output shaft 15*b* is coaxial with the steering rotation axis As). By adopting this configuration, it is possible to eliminate the need for the link mechanism for steering that was required in the case where the servo motor for steering is disposed on the vehicle body side as in a conventional configuration, and it is also possible to synchronize the rotation angle of the servo motor for steering with the rotation angle of the steerable wheel. By eliminating the need for the link mechanism for steering, it is possible to reduce a decrease in steering control accuracy caused by the connection backlash of the link mechanism. In addition, by eliminating the need for the link mechanism, it is possible to prevent the rotation angle of the steerable wheel from being changed depending on the steering angle. Consequently, it is possible to improve steering control accuracy in these aspects.

3. Input Attenuation Mechanism

Figure 8:
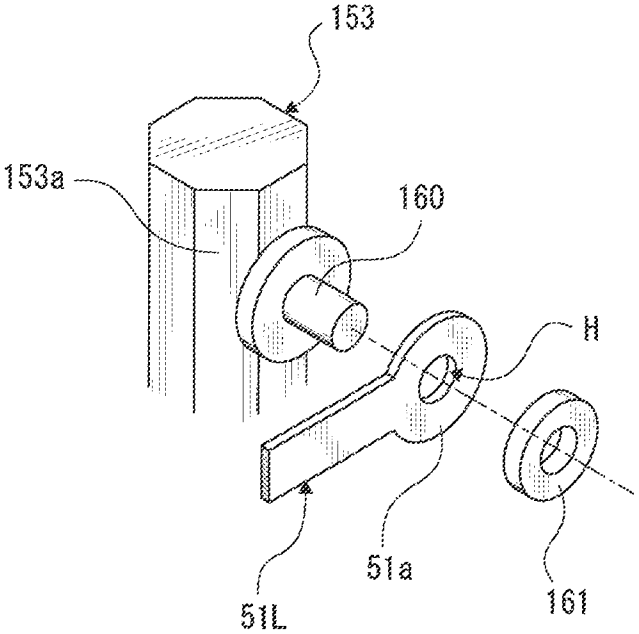
FIG. 8 illustrates an input attenuation mechanism provided on the model vehicle of the embodiment.
Figure 8:
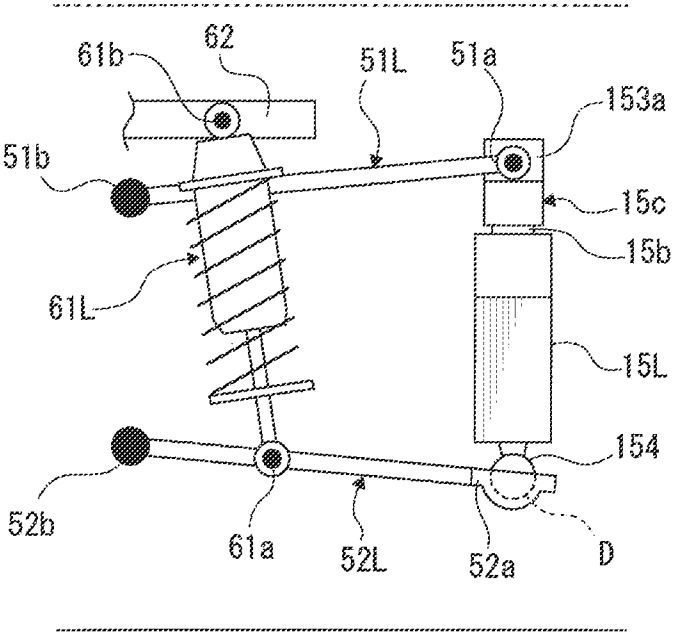
Figure 9:
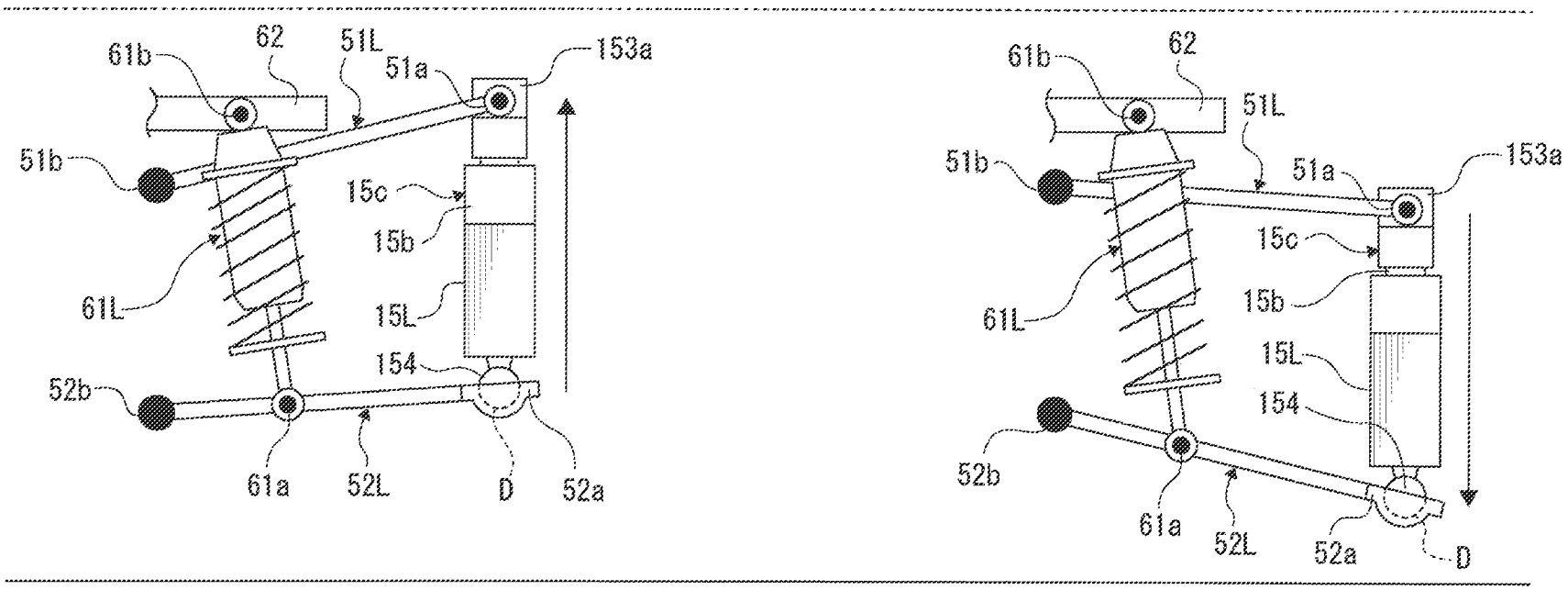
FIG. 9 also illustrates the input attenuation mechanism provided on the model vehicle of the embodiment.

In this embodiment, in addition to the adoption of the configuration in which the servo motor for steering 15 is disposed between the arm parts and the steerable wheel W, there is provided a configuration of an input attenuation mechanism for attenuating an input from a road surface through the steerable wheel W. Referring to FIG. 8 and FIG. 9, an input attenuation mechanism included in the model vehicle 1 according to an embodiment will be described.

FIG. 8 shows a front view (left side), i.e., a view from the front side of the vehicle of a part in the vicinity of the left side of the steering mechanism 50. In the drawing, the wheel hub part 53L and the steerable wheel WL are not shown. The model vehicle 1 of this embodiment includes a shock absorber 61L and a shock tower 62 as a configuration for attenuating the input. The shock absorber 61L includes a cylinder part within which a cushioning material such as a liquid is enclosed, and a spring which is wound around an outer circumference of the cylinder part, thus an impact applied to the spring can be absorbed by resistive force generated by the above-described liquid or gas or the like in the cylinder part. The shock tower 62 is a member configured to couple the right and left shock absorbers 61 to the chassis 1*a* side.

On the assumption that, in the steering mechanism 50 of the embodiment, the upper arm 51L is configured such that its vehicle body-side end part 51*b*, that is the basal part as described above and that is an end opposite to the distal end part 51*a*, is coupled to the chassis 1*a* so as to allow the upper arm 51L to swing vertically around the vehicle body-side end part 51*b* as a fulcrum. In addition, the upper arm 51L is configured such that the distal end part 51*a* is connected to the distal end part 153*a* of the pole part 153 so as to allow the upper arm 51L to swing vertically around the distal end part 51*a* as a fulcrum. That is, the distal end part 51*a* is coupled to the output shaft 15*b*.

FIG. 8 further shows a perspective view (right side) for explaining an example of a form of connection between the distal end part 51*a* of the upper arm 51L and the distal end part 153*a* of the pole part 153. As shown, a substantially cylindrical hook part 160 protruding to the front side of the model vehicle 1 is formed on the distal end part 153*a*, and a substantially circular hole H to which the hook part 160 is inserted is formed on the distal end part 51*a* of the upper arm 51L. The distal end part 51*a* in this case is sandwiched between the pole part 153 and a clamping member such as a nut 161 with the hook part 160 inserted into the hole H. With this configuration for example, the upper arm 51L is connected to the distal end part 153*a* of the pole part 153 in a manner capable of swinging vertically around the distal end part 51*a* as a fulcrum.

Further, the lower arm 52L is configured such that its vehicle body-side end part 52*b*, that is an end opposite to the distal end part 52*a*, is coupled to the chassis 1*a* so as to allow the lower arm 52L to swing vertically around the vehicle body-side end part 52*b* as a fulcrum. In addition, the lower arm 52L is configured such that the distal end part 52*a* is connected to the spherical part 154 so as to allow the lower arm 52L to swing vertically around the distal end part 52*a* as a fulcrum. That is, the distal end part 52*a* is coupled to the main body part 15*a* of the servo motor for steering 15L. Since the spherical portion of the spherical part 154 is slidably fitted into the recess D of the lower arm 52L as described above, the lower arm 52L is coupled to the main body part 15*a* of the servo motor for steering 15L in a manner capable of swinging vertically around the distal end part 52*a* as a fulcrum.

With the adoption of the configuration as described above, the shock absorber 61L is configured such that its lower end part 61*a* is coupled to the lower arm 52L so as to allow the lower arm 52L to swing vertically around the vehicle body-side end part 52*b* as a fulcrum and to swing vertically around the distal end part 52*a* as a fulcrum, as described above. In other words, the lower end part 61*a* of the shock absorber 61L is coupled to the lower arm 52 so as to allow the lower arm 52 to swing vertically around a connecting part between the lower end part 61*a* and the lower arm 52L, this connecting part being a fulcrum. Further, an upper end part 61*b* of the shock absorber 61L is connected to the shock tower 62 without the intervention of the upper arm 51L (i.e., the upper end part 61*b* is coupled to the vehicle body side).

The suspension structure described above is a so-called double wishbone suspension structure. The double wishbone suspension is a design using a parallel linkage, thus it is possible to avoid change in the camber angle even if the steerable wheel W moves up and down due to protrusions and depressions on the road surface. This is illustrated in FIG. 9, which shows the steering and the input attenuation mechanism when the steerable wheel WL passes on a protrusion on the road surface (left side in FIG. 9) and passes on a depression on the road surface (right side in FIG. 9) in a front view similar to that shown on the left side in FIG. 8. As can be seen from FIG. 9, the camber angle of the steerable wheel WL does not change with respect to the bumps on the road surface.

Further, according to the above-described double wishbone suspension structure, since the upper end part 61*b* of the shock absorber 61 is not coupled to the upper arm 51L, the operation of the attenuation of input from the road surface can be prevented from being interrupted with the adoption of the configuration in which the servo motor for steering 15 is inserted between the upper arm 51 and the lower arm 52.

As described above, it is also possible to adopt the configuration in which the distal end part 51*a* of the upper arm 51L is coupled to the main body part 15*a* via the spherical part 154, and the distal end part 52*a* of the lower arm 52L is coupled to the output shaft 15*b*. In this case, in order to enable the double wishbone suspension structure as described above, the upper arm 51L is at least configured such that the distal end part 51*a* is coupled to the main body part 15*a* so as to allow the upper arm 51L to swing vertically around the distal end part 51*a* as a fulcrum, and the lower arm 52L is at least configured such that the distal end part 52*a* is coupled to the output shaft 15*b* so as to allow the lower arm 52L to swing vertically around the distal end part 52*a* as a fulcrum.

With respect to the input attenuation mechanism, an explanation using the drawings for a configuration on the right side of the input attenuation mechanism is omitted because it is similar to that of the left side except that it is in a bilaterally symmetrical relationship with respect to the left side.

4. Another Example of Steering Mechanism

4-1. First Another Example

In the above description, the coupling between the output shaft 15*b* and the upper arm 51 has been shown in an exemplary configuration in which the output shaft 15*b* is coupled to the upper arm 51 via the connecting part 15*c*. It is also possible to adopt a configuration as shown in a first another example of FIG. 10 in which the distal end part of the output shaft 15*b* is directly connected to the distal end part 51*a* of the upper arm 51. In the following, elements similar to those already described above will be indicated with the same reference signs and description thereof is omitted.

Figure 10:
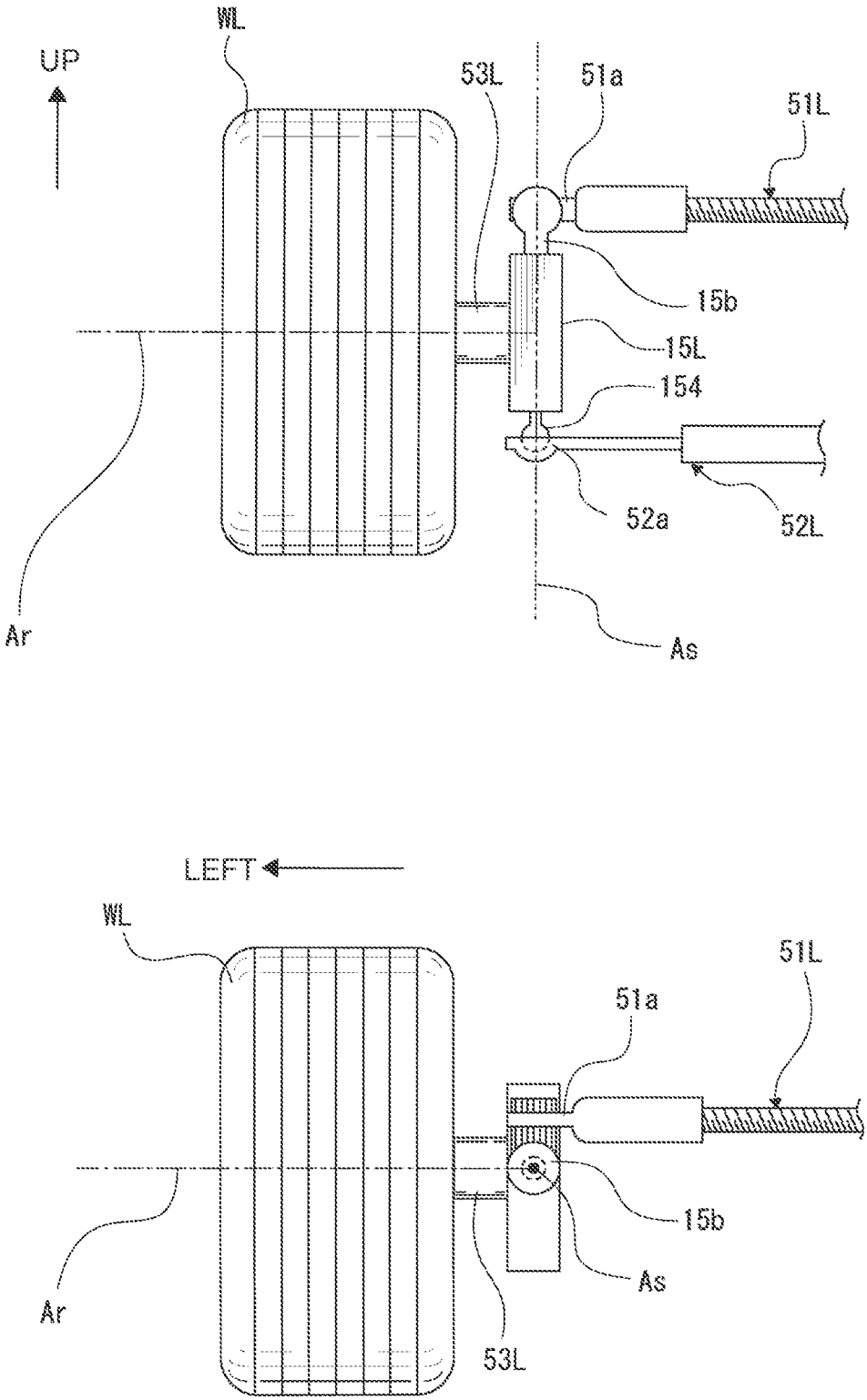
FIG. 10 illustrates a steering mechanism according to a first another example.

In this example, as shown in FIG. 10, the distal end part of the output shaft 15*b* is connected to the distal end part 51*a* of the upper arm 51 such that the output shaft 15*b* is incapable of rotating. Consequently, similar to the case of adopting the configuration described for example in FIG. 6, it is possible to enable a configuration in which the main body part 15*a* and the steerable wheel W move in conjunction with each other in accordance with the steering.

4-2. Second Another Example and Third Another Example

The description above shows, as an example of the steering mechanism 50 in which the servo motor for steering 15 is disposed between the arm parts and the steerable wheel W, a configuration in which the main body part 15*a* of the servo motor for steering 15 and the steerable wheel W move in conjunction with each other in accordance with the steering. However, it is not essential to adopt such configuration in which the main body part 15*a* and the steerable wheel W move in conjunction with each other in accordance with the steering. For example, as in a second another example shown in FIG. 11 and a third another example shown in FIG. 12, it is also possible to adopt a configuration in which a member (i.e., a rotating member 155 which is a to-be-connected member) to which the wheel hub part 53L is connected is rotationally driven by the rotational drive force of the output shaft 15*b* to rotationally drive the steerable wheel WL in the steering angle direction. In both examples of FIG. 11 and FIG. 12, the main body part 15*a* of the servo motor for steering 15L is coupled to the arm parts in a manner incapable of rotating. Specifically, in the example of FIG. 11, the main body part 15*a* includes a substantially cylindrical support part 15*d* protruding downward from the lower surface of the main body part 15*a*, and a distal end part (i.e., a lower end part) of the support part 15*d* is connected to the distal end part 52*a* of the lower arm 52L such that the main body part 15*a* is incapable of rotating. Further, the main body part 15*a* in this example is configured such that the upper end part of the main body part 15*a* is connected to the distal end part 51*a* of the upper arm 51 such that the main body part 15*a* is incapable of rotating. On the other hand, in the example of FIG. 12, the main body part 15*a* is fixed onto the lower arm 52L at a position closer to the basal side with respect to the distal end part 52*a* in a manner incapable of rotating.

Figure 11:
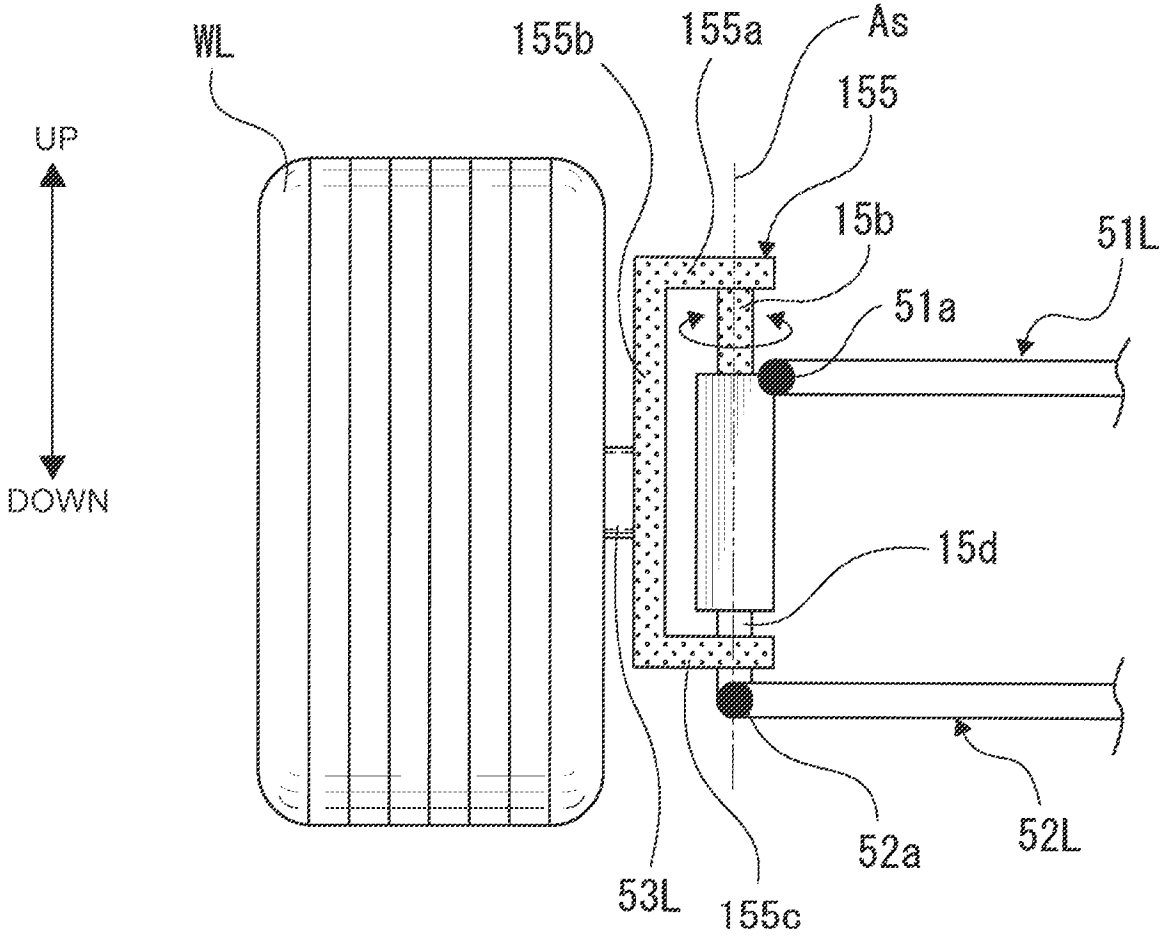
FIG. 11 illustrates a steering mechanism according to a second another example.

In the example of FIG. 11, the wheel hub part 53L is connected to the rotating member 155. As shown, the rotating member 155 has a substantially U-shaped cross-sectional shape in a rear view and includes an upper surface part 155*a* connected to the distal end part of the output shaft 15*b* such that the rotating member 155 rotates in conjunction with the output shaft 15*b* about a center axis which is the rotation axis of the output shaft 15*b*. Although not shown, a substantially circular hole is formed on a lower surface part 155*c* of the rotating member 155, and the support part 15*d* is inserted into this hole. In this case, the connection between the hole and the support part 15*d* is established for example via a ball bearing so as not to interrupt the rotation of the rotating member 155. As shown, the wheel hub part 53L is connected to an outer surface of a lateral side part 155*b* of the rotating member 155.

In the configuration shown in FIG. 11, when the servo motor for steering 15L is driven, the output shaft 15*b* rotates, and the rotating member 155 rotates in conjunction with the rotation of the output shaft 15*b* so that the steerable wheel WL is rotated in the steering angle direction. In this case, the steering rotation axis As is coaxial with the rotation axis of the output shaft 15*b*.

Figure 12:
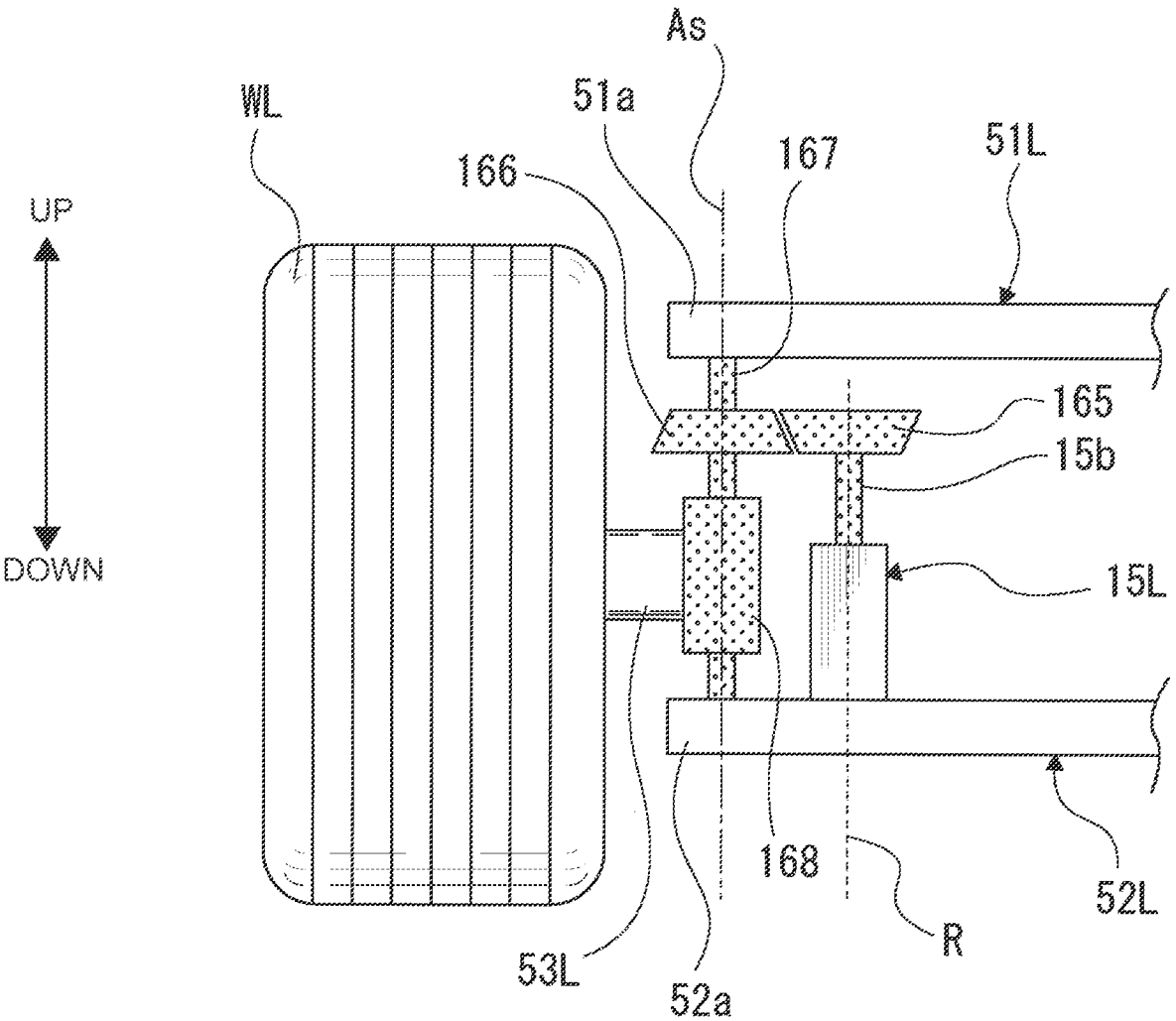
FIG. 12 illustrates a steering mechanism according to a third another example.

In the configuration shown in FIG. 12, the rotational drive force of the output shaft 15*b* is transmitted to a transmission shaft 167 by gears 165 and 166 shown in the drawing, and the steerable wheel WL is rotationally driven in the steering angle direction by a to-be-connected member 168 to which the wheel hub part 53L is connected, the to-be-connected member 168 being coaxial with the transmission shaft 167 and being configured to rotate in conjunction with the transmission shaft 167. The transmission shaft 167 is configured such that its upper end part is connected to the distal end part 51*a* of the upper arm 51L so as to allow the rotation of the transmission shaft 167, and a lower end part of the transmission shaft 167 is connected to the distal end part 52*a* of the lower arm 52L so as to allow the rotation of the transmission shaft 167. Transmission of power to the transmission shaft 167 side is performed by the gear 165 that is connected to the output shaft 15*b* via the gear 166 connected to the transmission shaft 167. The to-be-connected member 168 is disposed coaxially with the transmission shaft 167, and the wheel hub part 53L is connected to the lateral surface of the to-be-connected member 168.

In the configuration shown in FIG. 12, the steerable wheel WL is rotationally driven in the steering angle direction around the steering rotation axis As which does not coincide with the rotation axis of the transmission shaft 167 indicated by "R" in the drawing and which is parallel to the rotation axis R.

As can be seen from the second another example and the third another example, it is not essential to adopt the configuration in which the main body part 15*b* of the servo motor for steering 15 and the steerable wheel WL rotate in conjunction with each other. Further, as shown in the third another example, the output shaft 15*b* is not limited to being coaxial with the steering rotation axis As as long as it is at least parallel to the steering rotation axis As.

5. Angle Adjusting Mechanism

Figure 13:
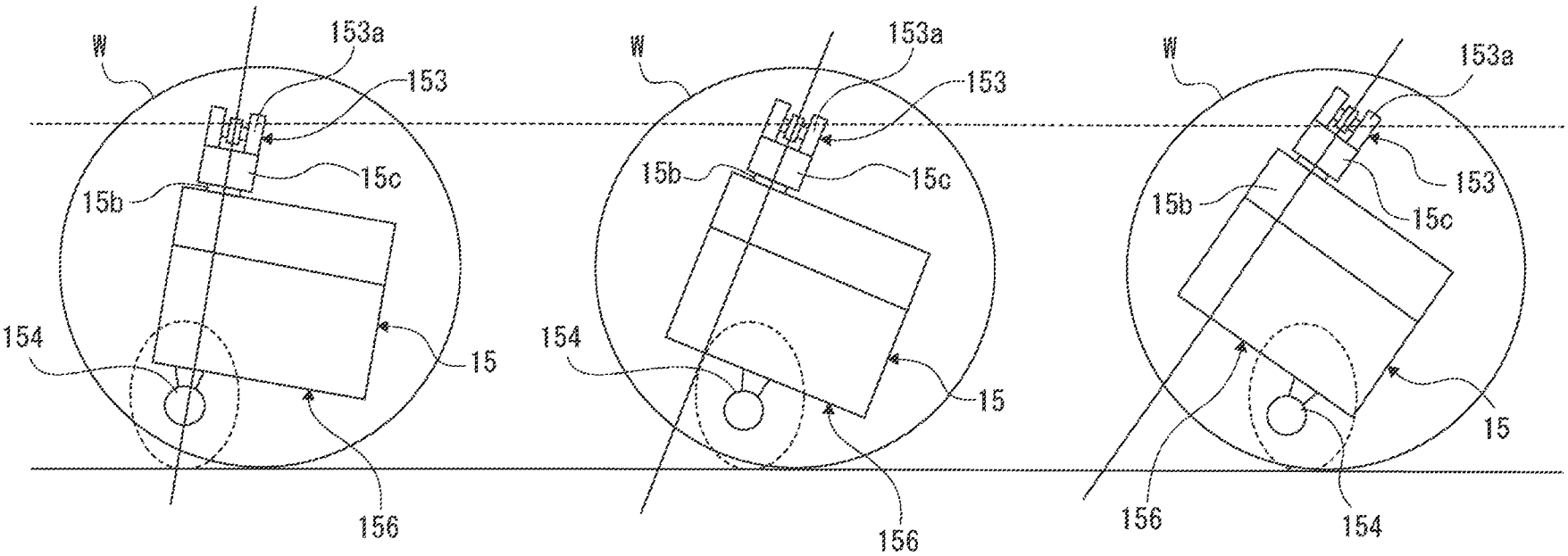
FIG. 13 illustrates an example of a connection position displacement mechanism for adjusting a caster angle.
Figure 14:
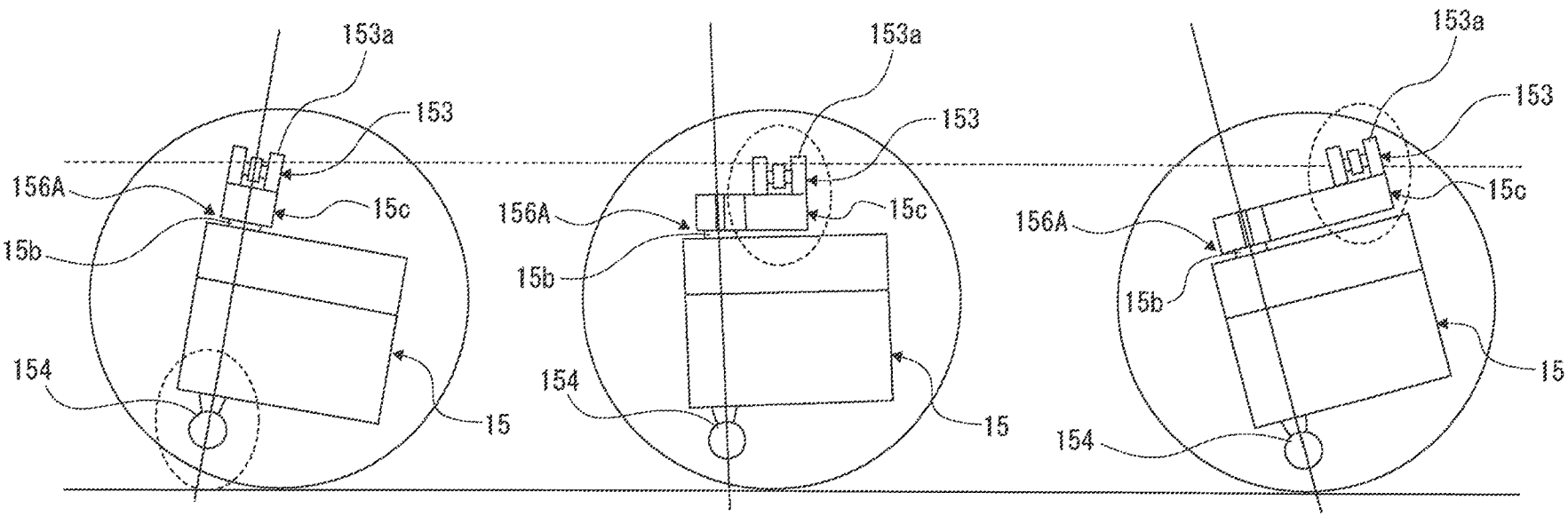
FIG. 14 illustrates another example of a connection position displacement mechanism for adjusting a caster angle.

In the servo motor for steering 15, the caster angle and the camber angle can be adjusted by providing a connection position displacement mechanism capable of displacing the position of connection with respect to the arm part side. FIG. 13 and FIG. 14 illustrate a connection position displacement mechanism 156 and a connection position displacement mechanism 156A configured to adjust the caster angle, respectively. FIG. 13 shows that the caster angle can be adjusted by changing the position of the spherical part 154 in the front-rear direction, i.e., the position of a connecting part with respect to the lower arm 52 in the front-rear direction. In this case, the connection position displacement mechanism 156 is configured as a mechanism capable of adjusting the position of the spherical part 154 in the front-rear direction. Specifically, holes are formed on the lower surface of the main body part 15*a* at a plurality of positions spaced apart in the front-rear direction, the holes being configured to position and detachably fix the respective spherical parts 154, thus these holes formed in the plurality of positions constitute the connection position displacement mechanism 156. Alternatively, the connection position displacement mechanism 156 may be configured as a mechanism that retains the spherical part 154 in a manner slidable in the front-rear direction.

FIG. 14 shows that the caster angle can be adjusted by changing the position of the distal end part 153*a* of the pole part 153 in the front-rear direction, i.e., the position of a connecting part with respect to the upper arm 51 in the front-rear direction. The position of the distal end part 153*a* in the front-rear direction can be changed by adjusting a mounting angle of the connecting part 15*c* to the output shaft 15*b* of the servo motor for steering 15 when the output shaft 15*b* is in the neutral state (i.e., the output shaft 15*b* is at a rotation angle in a non-drive state). Thus, the connection position displacement mechanism 156A in this case may be configured as a mechanism capable of adjusting the mounting angle.

Figure 15:
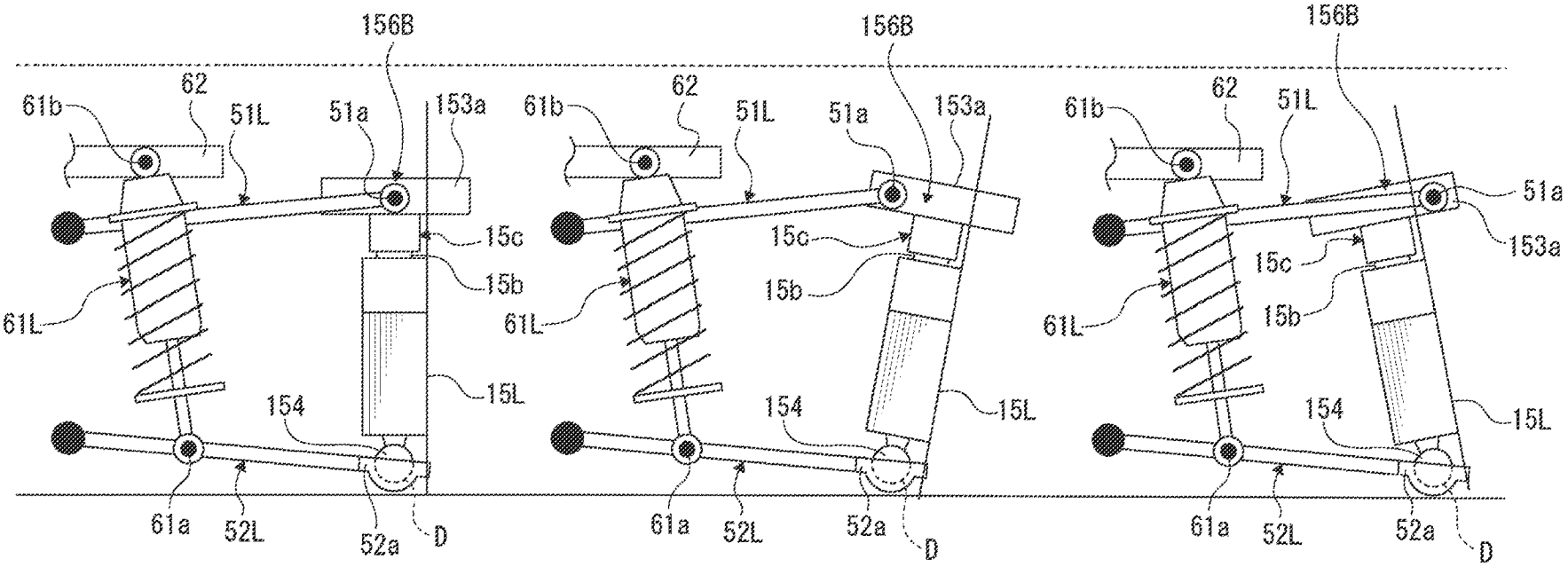
FIG. 15 illustrates an example of a connection position displacement mechanism for adjusting a camber angle.

FIG. 15 illustrates a connection position displacement mechanism 156B for adjusting the camber angle. Specifically, FIG. 15 shows that the camber angle can be adjusted by changing, in the right-left direction, the connection position of the distal end part 51*a* of the upper arm 51 with respect to the distal end part 153*a* of the pole part 153. Thus, the connection position displacement mechanism 156B is configured as a mechanism that is capable of adjusting, in the right-left direction, the connection position of the distal end part 153*a* of the pole part 153 with respect to the distal end part 52*a* of the upper arm 51. Specifically, for example, hook parts 160 (see FIG. 8) to which the respective distal end parts 52*a* are engaged, are formed on the front surface of the distal end part 153*a* at a plurality of positions spaced apart in the right-left direction, thus these hook parts 160 formed at the plurality of positions constitute the connection position displacement mechanism 156B. Alternatively, the connection position displacement mechanism 156B may be configured as a mechanism that retains the hook parts 160 in a manner slidable in the right-left direction.

6. Modified Example

The present invention is not limited to the specific examples described above and may adopt configurations as various modified examples. For example, in the above description there is shown the example in which the steering mechanism 50 adopts the bilaterally symmetrical configuration, but in an alternative example the steering mechanism of the present invention may adopt an asymmetrical configuration on at least a part of its right and/or left side.

Further, in the above description there is shown the example in which the present invention is applied to the model vehicle 1 which is a four-wheeled vehicle; however, the present invention is also suitably applicable to a model vehicle having two or more wheels and having one or more steerable wheels.

7. Summary of Embodiments

As described above, a steering mechanism (steering mechanism 50) of a model vehicle (model vehicle 1) according to an embodiment includes a servo motor for steering (servo motor for steering 15) configured to rotationally drive a steerable wheel (steerable wheel W) in a steering angle direction, the servo motor for steering being positioned between the steerable wheel and arm parts (upper arm 51, lower arm 52) extending from a vehicle body side, and being configured to rotationally drive the steerable wheel by an output shaft (output shaft 15*b*) parallel to a steering rotation axis (steering rotation axis As) of the steerable wheel. Since the servo motor for steering is positioned between the steerable wheel and the arm parts and is configured to rotationally drive the steerable wheel by the output shaft parallel to the steering rotation axis as described above, it is possible to eliminate the need for the link mechanism for steering that was required when the servo motor for steering is disposed on the vehicle body side as in the conventional art, and it is also possible to synchronize the rotation angle of the servo motor for steering synchronized with the rotation angle of the steerable wheel. By eliminating the need for the link mechanism for steering, it is possible to reduce a decrease in steering control accuracy caused by the connection backlash of the link mechanism. In addition, by eliminating the need for the link mechanism, it is possible to prevent the rotation angle of the steerable wheel from being changed depending on the steering angle. Consequently, it is possible to improve steering control accuracy in these aspects. Further, by eliminating the need for the link mechanism, it is also possible to rotate the steerable wheel 180 degrees. Further, according to the above-described configuration, in addition to eliminating the need for the link mechanism, the right and left steerable wheels can be steerably driven independently. Consequently, adjustment of Ackerman ratio can be performed electrically as the adjustment of the rotation angle of the servo motor for steering (thus, the adjustment can be performed while running). Herein, Ackerman ratio is defined as a difference in the steering angles of the right and left steerable wheels. If the steering angles of the right and left steerable wheels with respect to a certain steering amount are set to be the same, then the right and left steerable wheels depict circles of the same radius. However, at that time there is a difference for the vehicle width between the center of the arc depicted by the outside steerable wheel and the center of the arc depicted by the inside steerable wheel, thus the trajectory of the outside steerable wheel and the trajectory of the inside steerable wheel will intersect at a certain point in time, so the trajectory of the outside steerable wheel comes inside of the trajectory the inside steerable wheel. As can be understood from this, it will be difficult to smoothly turn the model vehicle if the steering angles of the right and left steerable wheels are set to be the same. Thus, for example, the steering angle adjustment of the right and left steerable wheels for providing desirable steering characteristics of the model vehicle, such as smoothly turning the model vehicle, is performed as the adjustment of the Ackerman ratio. Further, in comparison with a conventional steering mechanism that rotationally drives the right and left steerable wheels by an output of a single servo motor as the one shown in FIG. 6 of Patent Document 1 mentioned above, the steering mechanism according to the above-described embodiment enables adjusting the rotation angles of the right and left steerable wheels independently. Furthermore, since the rotation angle of the right and left steerable wheels can be adjusted independently, the toe angle can be adjusted electrically while running.

Further, in the steering mechanism of the model vehicle according to the embodiment, the output shaft of the servo motor for steering is positioned coaxially with the steering rotation axis (see FIG. 6, FIG. 7, FIG. 10 and FIG. 11). Thus, the rotational drive force generated by the servo motor for steering can be transmitted to the steerable wheel without passing through the gears illustrated in FIG. 12, for example. Consequently, in enabling the rotational drive of the steerable wheel by the servo motor for steering positioned between the arm parts and the steerable wheel, the number of components, size and weight of the steering mechanism can be reduced. Further, the reduction in the weight of the steering mechanism can reduce the weight of the model vehicle.

Furthermore, in the steering mechanism of the model vehicle according to the embodiment, the servo motor for steering includes a main body part (main body part 15*a*) that rotatably retains the output shaft, and includes, as the arm parts, a first arm part and a second arm part which are vertically spaced apart from each other. Further, the output shaft is supported from one of the first arm part side and the second arm part side in a manner incapable of rotating. Further, the main body part is supported from the other one of the first arm part side and the second arm part side in a manner capable of rotating around an axis parallel to a steering rotation axis, and a wheel hub part that rotatably retains the steerable wheel is coupled to the main body part (see FIG. 6, FIG. 7 and FIG. 10). As described above, since the output shaft is supported from one of the upper arm part side and the lower arm part side in a manner incapable of rotating and the main body part is supported from the other one of the upper arm part side and the lower arm part side in a manner capable of rotating around the axis parallel to the steering rotation axis, the servo motor for steering according to this embodiment is configured such that the main body part rotates around the axis parallel to the steering rotation axis in accordance with the steering. Moreover, since the wheel hub part is coupled to the main body part, the steerable wheel rotates in conjunction with the rotation of the main body part. Since the steerable wheel is configured to be rotationally driven in conjunction with the rotation of the main body part as described above, the steering mechanism of this embodiment does not require the output shaft to be connected to the transmission mechanism for transmitting the rotational force of the output shaft to the steerable wheel side (e.g., the rotating member 155 of FIG. 11, the transmission shaft 167 and the to-be-connected member 168 of FIG. 12), thereby reducing the number of components, size and weight of the steering mechanism. Moreover, the reduction of the weight of the steering mechanism can reduce the weight of the model vehicle.

Further, in the steering mechanism of the model vehicle according to the embodiment, a shock absorber (shock absorber 61) is provided on the vehicle body, the shock absorber being configured to attenuate an input from a road surface through the steerable wheel. The servo motor for steering includes a main body part that rotatably retains the output shaft. The arm parts include an upper arm part and a lower arm part which are vertically spaced apart from each other. The upper arm part includes a first end part coupled to the vehicle body side so as to allow the upper arm part to swing vertically around the first end part as a fulcrum, and a second end part coupled to one of the output shaft and the main body part so as to allow the upper arm part to swing vertically around the second end part as a fulcrum. The lower arm part includes a first end part coupled to the vehicle body side so as to allow the lower arm part to swing vertically around the first end part of the lower arm part as a fulcrum, and a second end part coupled to one of the output shaft and the main body part so as to allow the lower arm part to swing vertically around the second end part of the lower arm part as a fulcrum. The shock absorber includes a lower end part coupled to the lower arm part so as to allow the lower arm part to swing vertically around the first end part of the lower arm part as a fulcrum and to swing vertically around the second end part of the lower arm part as a fulcrum, and an upper end part coupled to the vehicle body side without intervention of the upper arm part (see FIG. 8 and FIG. 9). That is to say, the so-called double wishbone suspension structure is adopted. The double wishbone suspension is a design using a parallel linkage, thus it is possible to avoid change in the camber angle even if the steerable wheel moves up and down due to protrusions and depressions on the road surface. Further, since the upper end part of the shock absorber is not coupled to the upper arm part, the operation of attenuation of input from the road surface can be prevented from being interrupted with the adoption of the configuration in which the servo motor for steering is inserted between the upper arm part and the lower arm part.

Further, in the steering mechanism of the model vehicle according to the embodiment, the servo motor for steering includes a connection position displacement mechanism (connection position displacement mechanism 156, 156A, 156B) capable of displacing a position of connection to the arm part side. Since the position of connection of the arm part to the servo motor for steering positioned between the arm part and the steerable wheel can be changed freely, the caster angle and the camber angle can be adjusted.

A servo motor for steering (servo motor for steering 15) according to the embodiment is configured to rotationally drive a steerable wheel of a model vehicle in a steering angle direction, wherein the servo motor for steering is positioned between arm parts and the steerable wheel, the arm parts extending from a vehicle body side of the model vehicle to the steerable wheel, and the servo motor for steering comprises an output shaft parallel to a steering rotation axis of the steerable wheel and is configured to rotationally drive the steerable wheel by the output shaft. The same operation as the steering mechanism according to the above-described embodiment can be obtained with this servo motor for steering. Thus, steering control accuracy can be improved in the steering mechanism of the model vehicle.

Further, the servo motor for steering according to the embodiment further includes a main body part that rotatably retains the output shaft, wherein a to-be-connected part (to-be-connected part 151) to which a wheel hub part is connected is formed on the main body part, the wheel hub part being configured to rotatably retain the steerable wheel. Thus, with the adoption of the configuration in which the main body part is rotated around the axis parallel to the steering rotation axis in accordance with the steering, the steerable wheel can be rotated in conjunction with the rotation of the main body part. Consequently, the steerable wheel can be appropriately rotated in the steering angle direction.

Further, the servo motor for steering according to the embodiment further includes a connection position displacement mechanism capable of displacing a position of connection to the arm part side. Since the position of connection of the arm part to the servo motor for steering positioned between the arm part and the steerable wheel can be changed freely, the caster angle and the camber angle can be adjusted.

LIST OF REFERENCE SIGNS

1 model vehicle
1*a* chassis
2 transmitter
10 receiver
11, 27 antenna
15 (15L, 15R) servo motor for steering
20 interface unit
21 (21X, 21Y) operation lever
23 display unit
24 setting operation unit
W (WL, WR) steerable wheel
50 steering mechanism
51 (51L, 51R) upper arm
52 (52L, 52R) lower arm
51*a*, 52*a* distal end part
51*b*, 52*b* body-side end part
53 (53L, 53R) wheel hub part
61 (61L, 61R) shock absorber
62 shock tower
61*a* lower end part
61*b* upper end part
15*a* main body part
15*b* output shaft
15*c* connecting part
15*d* support part
151 to-be-connected part
152 plate-shaped part
153 pole part
153*a* distal end part
154 spherical part
D recess
155 rotating member
155*a* upper surface part
155*b* lateral side part
155*c* lower surface part
156, 156A, 156B connection position displacement mechanism
160 hook part
161 nut
H hole
165, 166 gear
167 transmission shaft
168 to-be-connected member

What is claimed is:

1. A steering mechanism of a model vehicle comprising:
a steerable wheel of the model vehicle;
arm parts extending from a vehicle body side of the model vehicle to the steerable wheel; and
a servo motor for steering configured to rotationally drive the steerable wheel in a steering angle direction, wherein
the servo motor for steering is positioned between the arm parts and the steerable wheel and is configured to rotationally drive the steerable wheel by an output shaft parallel to a steering rotation axis of the steerable wheel,
the servo motor for steering includes a main body part that rotatably retains the output shaft,
the arm parts include a first arm part and a second arm part which are vertically spaced apart from each other,
the output shaft is supported from one of the first arm part side and the second arm part side in a manner incapable of rotating with respect to the one of the first arm part side and the second arm part side,
the main body part is supported from another one of the first arm part side and the second arm part side in a manner capable of rotating around an axis parallel to the steering rotation axis with respect to the another one of the first arm part side and the second arm part side, and
a wheel hub part that rotatably retains the steerable wheel is coupled to the main body part.

2. The steering mechanism according to claim 1, wherein the output shaft of the servo motor for steering is positioned coaxial with the steering rotation axis.

3. The steering mechanism according to claim 1, wherein
a shock absorber is provided on the vehicle body, the shock absorber being configured to attenuate an input from a road surface through the steerable wheel,
the servo motor for steering includes a main body part that rotatably retains the output shaft,
the arm parts include an upper arm part and a lower arm part which are vertically spaced apart from each other,
the upper arm part includes
a first end part coupled to the vehicle body side so as to allow the upper arm part to swing vertically around the first end part as a fulcrum, and
a second end part coupled to one of the output shaft and the main body part so as to allow the upper arm part to swing vertically around the second end part as a fulcrum,
the lower arm part includes
a first end part coupled to the vehicle body side so as to allow the lower arm part to swing vertically around the first end part of the lower arm part as a fulcrum, and
a second end part coupled to one of the output shaft and the main body part so as to allow the lower arm part to swing vertically around the second end part of the lower arm part as a fulcrum, and
the shock absorber includes
a lower end part coupled to the lower arm part so as to allow the lower arm part to swing vertically around the first end part of the lower arm part as a fulcrum and to swing vertically around the second end part of the lower arm part as a fulcrum, and an upper end part coupled to the vehicle body side without intervention of the upper arm part.

4. The steering mechanism according to claim 1, wherein the servo motor for steering includes a spherical part capable of changing a connection position of the servo motor to the another one of the first arm part side and the second arm part side.

5. The steering mechanism according to claim 4, wherein the servo motor includes holes formed on a lower surface of the main body part at a plurality of positions spaced apart in a front-rear direction, the holes being configured to position and detachably fix the spherical part.

6. The steering mechanism according to claim 4, wherein the servo motor includes a mechanism that retains the spherical part in a manner slidable in a front-rear direction.

7. The steering mechanism according to claim 1, wherein a distal end part of the output shaft is attached with a first arm connection part for attachment to the one of the first arm part side and the second arm part side, the first arm connection part includes:

a plate-shaped part arranged in parallel to a plane perpendicular to the output shaft, and a pole part extending from an end of the plate-shaped part in a direction parallel to the output shaft, and a position of the first arm connection part in a front-rear direction, which is a position of the distal end part of the pole part in the front-rear direction, is changed.

8. The steering mechanism according to claim 7, wherein the position of the distal end part of the pole part in the front-rear direction can be changed by adjusting a mounting angle of the first arm connection part with respect to the output shaft when the output shaft is in the neutral state.

9. The steering mechanism according to claim 1, wherein a distal end part of the output shaft is attached with a first arm connection part for attachment to the one of the first arm part side and the second arm part side, the first arm connection part includes:

a plate-shaped part arranged in parallel to a plane perpendicular to the output shaft, and a pole part extending from an end of the plate-shaped part in a direction parallel to the output shaft, and a connection position of a distal end part of the first arm connection part with respect to a distal end part of the pole part is changed in a right-left direction.

10. A servo motor for steering configured to rotationally drive a steerable wheel of a model vehicle in a steering angle direction, wherein the servo motor for steering is positioned between arm parts and the steerable wheel, the arm parts extending from a vehicle body side of the model vehicle to the steerable wheel, and the servo motor for steering comprises an output shaft parallel to a steering rotation axis of the steerable wheel and is configured to rotationally drive the steerable wheel by the output shaft, the servo motor for steering includes a main body part that rotatably retains the output shaft, the arm parts include a first arm part and a second arm part which are vertically spaced apart from each other, the output shaft is supported from one of the first arm part side and the second arm part side in a manner incapable of rotating with respect to the one of the first arm part side and the second arm part side, the main body part is supported from another one of the first arm part side and the second arm part side in a manner capable of rotating around an axis parallel to the steering rotation axis with respect to the another one of the first arm part side and the second arm part side, and a wheel hub part that rotatably retains the steerable wheel is coupled to the main body part.

11. The servo motor for steering according to claim 10, further comprising a main body part that rotatably retains the output shaft, wherein a to-be-connected part to which a wheel hub part is connected is formed on the main body part, the wheel hub part being configured to rotatably retain the steerable wheel.

12. The servo motor for steering according to claim 10, further comprising a spherical part capable of changing a connection position of the servo motor to the another one of the first arm part side and the second arm part side.

13. The servo motor for steering according to claim 12, further comprising holes formed on a lower surface of the main body part at a plurality of positions spaced apart in a front-rear direction, the holes being configured to position and detachably fix the spherical part.

14. The servo motor for steering according to claim 12, wherein the servo motor includes a mechanism that retains the spherical part in a manner slidable in a front-rear direction.

15. The servo motor for steering according to claim 10, wherein a distal end part of the output shaft is attached with a first arm connection part for attachment to the one of the first arm part side and the second arm part side, the first arm connection part includes:

a plate-shaped part arranged in parallel to a plane perpendicular to the output shaft, and a pole part extending from an end of the plate-shaped part in a direction parallel to the output shaft, and a position of the first arm connection part in a front-rear direction, which is a position of the distal end part of the pole part in the front-rear direction, is changed.

16. The servo motor for steering according to claim 15, wherein the position of the distal end part of the pole part in the front-rear direction can be changed by adjusting a mounting angle of the first arm connection part with respect to the output shaft when the output shaft is in the neutral state.

17. The servo motor for steering according to claim 10, wherein a distal end part of the output shaft is attached with a first arm connection part for attachment to the one of the first arm part side and the second arm part side, the first arm connection part includes:

a plate-shaped part arranged in parallel to a plane perpendicular to the output shaft, and a pole part extending from an end of the plate-shaped part in a direction parallel to the output shaft, and a connection position of a distal end part of the first arm connection part with respect to a distal end part of the pole part is changed in a right-left direction.

* * * * *